US005582943A

United States Patent [19]

Kato et al.

[11] Patent Number: 5,582,943

[45] Date of Patent: Dec. 10, 1996

[54] METHOD OF FORMING AN ELECTROPHOTOGRAPHIC COLOR TRANSFER IMAGE AND ELECTROPHOTOGRAPHIC LIGHT-SENSITIVE MATERIAL FOR USE THEREIN

[75] Inventors: Eiichi Kato; Yusuke Nakazawa; Sadao Osawa, all of Shizuoka, Japan

[73] Assignee: Fuji Photo Film Co., Ltd, Kanagawa, Japan

[21] Appl. No.: 217,060

[22] Filed: Mar. 24, 1994

[30] Foreign Application Priority Data

Mar. 25, 1993 [JP] Japan ..... 5-089528
Mar. 30, 1993 [JP] Japan ..... 5-093834

[51] Int. Cl.[6] ..... G03G 5/147

[52] U.S. Cl. ..... 430/66; 430/126

[58] Field of Search ..... 430/45, 47, 66, 430/126

[56] References Cited

U.S. PATENT DOCUMENTS 4,686,163 8/1987 Ng et al. ..... 430/47
5,071,728 12/1991 Watts ..... 430/47

*Primary Examiner*—John Goodrow
*Attorney, Agent, or Firm*—Sughrue, Mion, Zinn, Macpeak & Seas

[57] ABSTRACT

A method of forming an electrophotographic color transfer image comprising forming at least one color toner image on a transfer layer provided on the surface of an electrophotographic light-sensitive element by an electrophotographic process and heat-transferring the toner image together with the transfer layer onto a receiving material wherein the surface of the electrophotographic light-sensitive element has an adhesive strength of not more than 200 gram.force, which is measured according to JIS Z 0237-1980 "Testing methods of pressure sensitive adhesive tapes and sheets" and the transfer layer mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C.

The method is excellent in obtaining color duplicates having good image quality without color shear and good storage stability at a low cost. An electrophotographic light-sensitive material suitable for use in the method is also described.

18 Claims, 3 Drawing Sheets

FIG.5
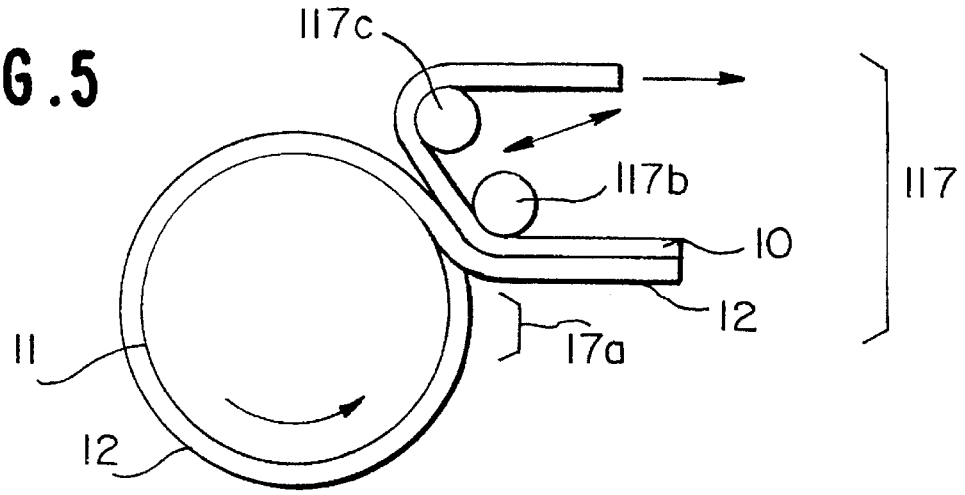
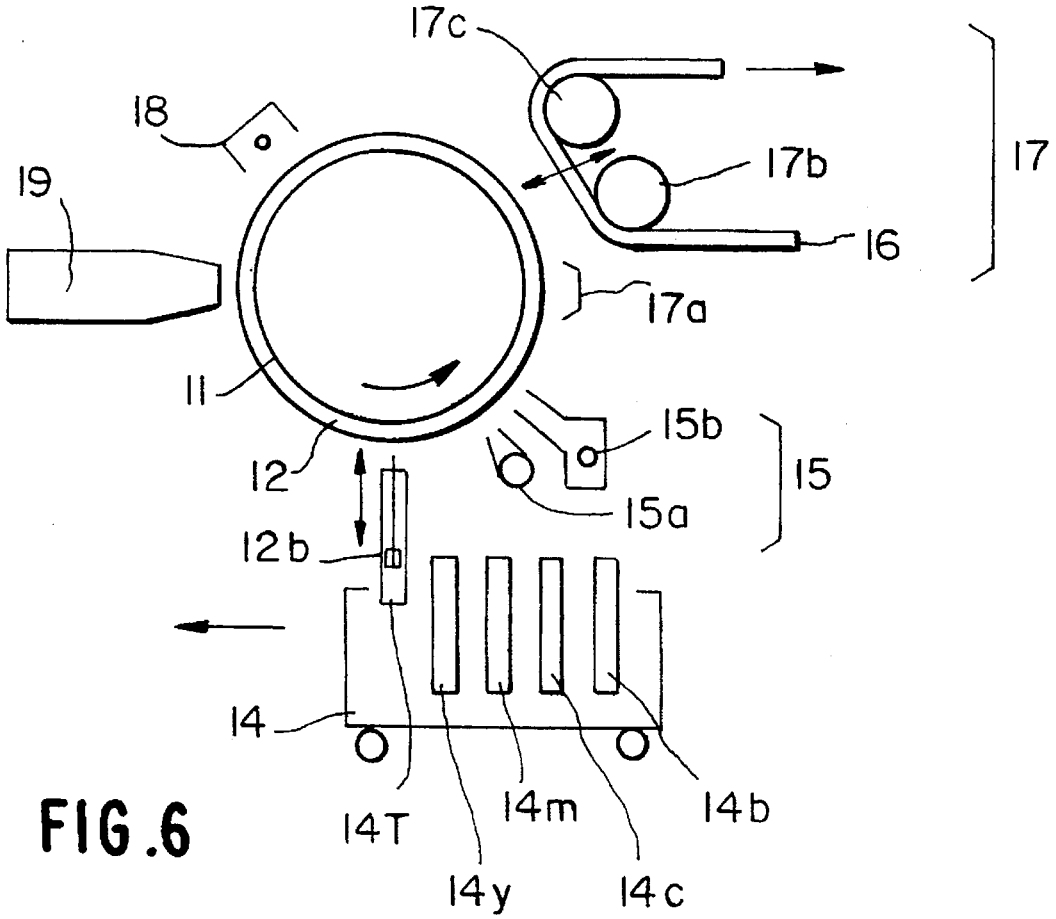
FIG.6

METHOD OF FORMING AN ELECTROPHOTOGRAPHIC COLOR TRANSFER IMAGE AND ELECTROPHOTOGRAPHIC LIGHT-SENSITIVE MATERIAL FOR USE THEREIN

FIELD OF THE INVENTION

The present invention relates to a method of forming an electrophotographic color transfer image, and more particularly to a method of forming a color transfer image using an electrophotographic process by which toner images are completely transferred onto a receiving material without being accompanied by degradation of image quality upon the transfer and which provides color duplicates being free from color shear and having good storage stability, and an electrophotographic light-sensitive material for use therein.

BACKGROUND OF THE INVENTION

Methods of forming color printings, color duplicates or color proofs (proofs for printing) which comprises conducting development with electrophotographic developing agents to form a plurality of overlapping color toner images directly on the surface of electrophotographic light-sensitive element and transferring at once the resulting color images onto a receiving material such as printing paper are known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to printing paper.

In order to solve this problem, a transfer technique in which a non-aqueous solvent is supplied between a light-sensitive element and a receiving material and then transfer is electrostatically performed is described in JP-A-2-272469 (the term "JP-A" as used herein means an "unexamined published Japanese patent application").

Also, a method in which a transparent film is first laminated on the surface of a light-sensitive element, wet type toner images are formed by an electrophotographic process on the film, and then the film bearing the toner images is separated from the light-sensitive element and stuck on paper, thereby forming transferred images is described in JP-A-2-115865 and JP-A-2-115866. According to the method, the film to be laminated has suitably a thickness of 9 μm. However, the production and handling of a film having such thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form overlapping color separation images on a dielectric support releasably provided on the light-sensitive element and the dielectric support bearing the images is transferred to a receiving material is described. Since the imagewise exposure is performed from the side of substrate for the light-sensitive element according to this method, the substrate is required to be transparent. This is disadvantageous in view of a cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper is described in JP-A-1-112264, JP-A-1-281464 and JP-A-3-11347.

However, in order to obtain good color images by a color image-forming method in which toner images are transferred together with the transfer layer to a printing paper various kinds of requirements must be satisfied.

First, it is important that the transfer layer should be uniform in order to perform uniform charging and exposure to light and not degrade electrophotographic characteristics (e.g., chargeability, dark charge retention rate and photosensitivity) of an electrophotographic light-sensitive element since toner images are formed upon an electrophotographic process. Also, the transfer layer is desired to have good releasability from an electrophotographic light-sensitive element and good adhesion to a receiving material in order to conduct easy transfer in the transfer step. Particularly, an enlarged latitude of transfer conditions (for example, heating temperature, pressure and transportation speed) is required. Moreover, it is desired that a color duplicate obtained accept retouching and sealing without causing any trouble and have good storage stability, for example, in that the transfer layer is not peeled off when the color duplicate has been filed between plastic sheets and piled up.

However, these characteristics have not been fully considered in the techniques hitherto known and image forming performance of color image, transferability of transfer layer and retouching property, sealing property and storage stability of color duplicate are not satisfactorily good.

Also, in order to employ the light-sensitive element repeatedly in the techniques hitherto known, a special operation is required at the time of transfer or difficulties in the formation of transfer layer are encountered. On the other hand, the method using a light-sensitive element having a transfer layer (or a releasable layer) previously formed thereon is disadvantageous in point of cost since the light-sensitive element used is inevitably thrown.

SUMMARY OF THE INVENTION

The present invention is to solve the above-described various problems associated with conventional techniques.

An object of the present invention is to provide a method of forming an electrophotographic color transfer image which provides simply and stably color images of high accuracy and high quality without color shear, in which a transfer layer has good releasability from an electrophotographic light-sensitive element and good adhesion to a receiving material and a color duplicate formed by which method has good retouching property, sealing property and storage stability.

Another object of the present invention is to provide a method of forming an electrophotographic color transfer image in which a transfer layer bearing toner images formed is easily transferred onto a receiving material under transfer conditions of enlarged latitude and irrespective of the kind of receiving material to be used.

A further object of the present invention is to provide a method of forming an electrophotographic color transfer image in which a transfer layer is easily prepared on a light-sensitive element on demand in an apparatus and the light-sensitive element is repeatedly usable, thereby reducing a running cost.

A still further object of the present invention is to provide an electrophotographic light-sensitive material which is suitable for use in the above-described method of forming an electrophotographic color transfer image.

Other objects of the present invention will become apparent from the following description and examples.

It has been found that the above described objects of the present invention are accomplished by a method of forming an electrophotographic color transfer image comprising forming at least one color toner image on a transfer layer provided on the surface of an electrophotographic light-sensitive element by an electrophotographic process and heat-transferring the toner image together with the transfer layer onto a receiving material wherein the surface of the electrophotographic light-sensitive element has an adhesive strength of not more than 200 gram.force, which is measured according to JIS Z 0237-1980 "Testing methods of pressure sensitive adhesive tapes and sheets" and the transfer layer mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C.

It has also been found that they are accomplished by an electrophotographic light-sensitive material comprising an electrophotographic light-sensitive element a surface of which has an adhesive strength of not more than 200 gram.force, which is measured according to JIS Z 0237-1980 "Testing methods of pressure sensitive adhesive tapes and sheets" and a transfer layer provided thereon which mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C.

BRIEF DESCRIPTION OF THE ACCOMPANYING DRAWINGS

FIG. 5 is a schematic view of an apparatus for the formation of transfer.layer utilizing release paper.

FIG. 6 is a schematic view of an electrophotographic color transfer image-forming apparatus using an electrodeposition coating method for the formation of transfer layer.

EXPLANATION OF THE SYMBOLS

1-Support of light-sensitive element
2-Light-sensitive layer
3-Toner image
4-Roller covered with rubber
5-Integrated heater
6-Surface temperature detective means
7-Temperature controller
10-Release paper
11-Light-sensitive element
12-Transfer layer
12*a*-Thermoplastic resin
12*b*-Dispersion of thermoplastic resin grains
13-Hot-melt coater
13*a*-Stand-by position of hot-melt coater
14-Liquid developing unit set
14T-Electrodeposition unit
14*y*-Yellow liquid developing unit
14*m*-Magenta liquid developing unit
14*c*-Cyan liquid developing unit
14*b*-Black liquid developing unit
15-Suction/exhaust unit
15*a*-Suction part
15*b*-Exhaust part
16-Receiving material
17-Heat transfer means
17*a*-Pre-heating means
17*b*-Heating roller
17*c*-Cooling roller
18-Corona charger
19-Exposure device
117-Heat transfer means
117*b*-Heating roller
117*c*-Cooling roller

DETAILED DESCRIPTION OF THE INVENTION

The method of forming an electrophotographic color transfer image according to the present invention will be diagrammatically described with reference to FIG. 1 of the drawings.

Figure 1A:
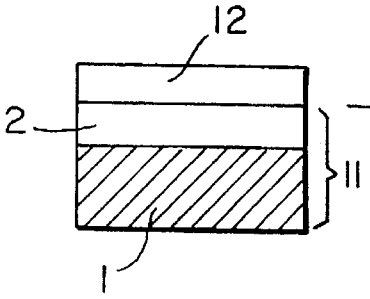
FIG. 1(*a–c*) is a schematic view for explanation of the method according to the present invention.
Figure 1B:
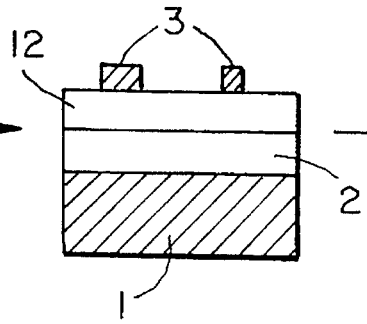
Figure 1C:
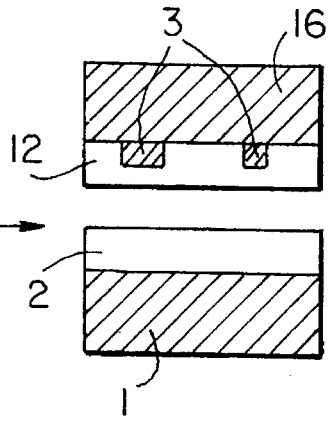

As shown in FIG. 1, the method comprises forming at least one color toner image 3 by a conventional electrophotographic process on an electrophotographic light-sensitive material comprising (i) an electrophotographic light-sensitive element having at least a support 1 and a light-sensitive layer 2 and (ii) a transfer layer 12 mainly containing the thermoplastic resins (AH) and (AL) having a glass transition point or a softening point different from each other provided thereon as the uppermost layer, and transferring the toner image 3 together with the transfer layer 12 onto a receiving material, thereby providing a color transfer image.

The transfer layer which can be used in the present invention is characterized by comprising a combination of at least one thermoplastic resin (AH) and at least one thermoplastic resins (AL) which has a glass transition point or a softening point of at least 2° C. lower than a glass transition point or a softening point, respectively, of the thermoplastic resin (AH). The transfer layer has a feature in that no deterioration of electrophotographic characteristics (such as chargeability, dark charge retention rate, and photosensitivity) occur until a toner image is formed by an electrophotographic process, thereby forming a good duplicated image. The transfer layer used in the present invention also has sufficient thermoplasticity for easy transfer to a receiving material in a heat transfer process in spite of the kind of receiving material. Further, the transfer layer transferred on a receiving material accepts retouching and sealing without causing any trouble and has good storage stability in that the transfer layer is not peeled from the receiving material when the duplicate has been filed between plastic sheets and piled up during storage.

On the other hand, the electrophotographic light-sensitive element which can be used in the present invention is characterized by having the specific adhesive strength described above on its surface in contact with the transfer layer in order to easily release the transfer layer.

Now, the transfer layer which can be used in the present invention will be described in greater detail below.

The transfer layer of the present invention is radiation-transmittive. Specifically, it is a layer capable of transmitting a radiation having a wavelength which constitutes at least one part of the spectrally sensitive region of electrophotographic light-sensitive element. The layer may be colored. In a case wherein duplicated images transferred on a receiving material are color images, particularly full-color images, a colorless and transparent transfer layer is usually employed.

As described above, the thermoplastic resin (AH) having a relatively high glass transition point or softening point and a thermoplastic resin (AL) having a relatively low glass transition point or softening point are used in combination in the transfer layer. The thermoplastic resin (AH) has a glass transition point of suitably from 10° C. to 140° C., preferably from 30° C. to 120° C., and more preferably from 35° C. to 90° C., or a softening point of suitably from 35° C. to 180° C., preferably from 38° C. to 160° C., and more preferably from 40° C. to 120° C., and on the other hand, the thermoplastic resin (AL) has a glass transition point of suitably not more than 45° C., preferably from −50° C. to 38° C., and more preferably from −40° C. to 33° C., or a softening point of suitably not more than 60° C., preferably from 0° C. to 40° C., and more preferably from 5° C. to 35° C. The difference in the glass transition point or softening point between the resin (AH) and the resin (AL) used is at least 2° C., preferably at least 5° C., and more preferably in a range of from 10° C. to 50° C. The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

A weight ratio of the thermoplastic resin (AH)/the thermoplastic resin (AL) used in the transfer layer is preferably from 5/95 to 90/10, more preferably from 10/90 to 70/30.

A weight average molecular weight of the thermoplastic resin (AH) is preferably from $1\times10^3$ to $1\times10^5$, more preferably from $3\times10^3$ to $5\times10^4$, and a weight average molecular weight of the thermoplastic resin (AL) is preferably from $3\times10^3$ to $1\times10^6$, more preferably from $5\times10^3$ to $5\times10^5$.

The thermoplastic resins (AH) and (AL) which can be used in the present invention may include any thermoplastic resins which satisfy the above described requirement on thermal property. Suitable examples of such thermoplastic resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins. Specific examples of resins are described, e.g., in *Plastic Zairyo Koza Series*, Vols. 1 to 18, Nikkan Kogyo Shinbunsha (1961), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook* (*Oyohen*), Ch. 1, Baifukan (1986), and Yuji Harasaki, *Saishin Binder Gijutsu Binran*, Ch. 2, Sogo Gijutsu Center (1985).

According to the present invention, thermoplastic resins to be used as the thermoplastic resins (AH) and (AL) are appropriately selected in order to satisfy the conditions described above.

The thermoplastic resins (AH) and/or (AL) preferably contains a polymer component (s) containing a moiety having at least one of a fluorine atom and a silicon atom in order to increase the releasability of the transfer layer itself.

The moiety having a fluorine atom and/or a silicon atom contained in the thermoplastic resin satisfying the above described requirement on thermal property includes that incorporated into the main chain of the polymer and that contained as a substituent in the side chain of the polymer.

The polymer components (s) are preferably present as a block in the thermoplastic resin. The content of polymer component (s) is preferably from 1 to 40 parts by weight, more preferably from 5 to 30 parts by weight per 100 parts by weight of the thermoplastic resin. The polymer component (s) may be incorporated into any of the thermoplastic resin (AH) and the thermoplastic resin (AL). It is desirable to incorporate the polymer component (s) into the thermoplastic resin (AH) in order to effectively increase the releasability of the transfer layer from the electrophotographic light-sensitive element, resulting in improvement of the transferability.

The polymer component containing the moiety having a fluorine atom and/or a silicon atom will be described below.

The fluorine atom-containing moieties include monovalent or divalent organic residues, for example, $-C_hF_{2h+1}$ (wherein h represents an integer of from 1 to 18), $-(CF_2)_jCF_2H$ (wherein j represents an integer of from 1 to 17), —CFH,

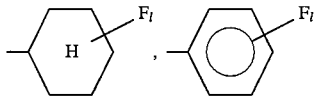

wherein l represents an integer of from 1 to 5), $-CF_2-$, —CFH—,

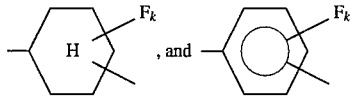

(wherein k represents an integer of from 1 to 4).

The silicon atom-containing moieties include monovalent or divalent organic residues, for example,

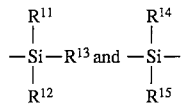

wherein $R^{11}$, $R^{12}$, $R^{13}$, $R^{14}$, and $R^{15}$, which may be the same or different, each represents a hydrocarbon group which may be substituted or $—OR^{16}$ wherein $R^{16}$ represents a hydrocarbon group which may be substituted.

The hydrocarbon group represented by $R^{11}$, $R^{12}$, $R^{13}$, $R^{14}$ or $R^{15}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl). $R^{16}$ in $—OR^{16}$ has the same meaning as the above-described hydrocarbon group for $R^{11}$.

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—,

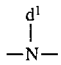

—SO—, $—SO_2—$, —COO—, —OCO—, —CONHCO—, —NHCONH—,

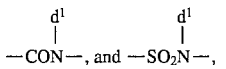

wherein $d^1$ has the same meaning as $R^{11}$ above.

Examples of the divalent aliphatic groups are shown below.

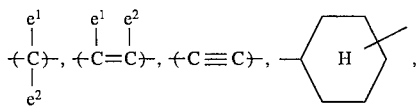

-continued

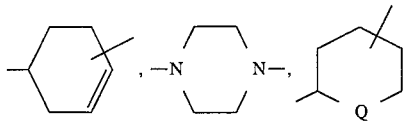

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

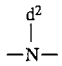

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (s-1) to (s-32) below, $R_f$ represents any one of the following groups of from (1) to (11); and b represents a hydrogen atom or a methyl group.

$$-C_nF_{2n+1} \quad (1)$$

$$-CH_2C_nF_{2n+1} \quad (2)$$

$$-CH_2CH_2C_nF_{2n+1} \quad (3)$$

$$-CH_2(CF_2)_mCFHCF_3 \quad (4)$$

$$-CH_2CH_2(CF_2)_mCFHCF_3 \quad (5)$$

$$-CH_2CH_2(CF_2)_mCFHCF_2H \quad (6)$$

$$-CH_2(CF_2)_mCFHCF_3 \quad (7)$$

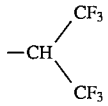

(8)

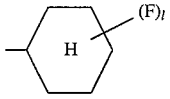

(9)

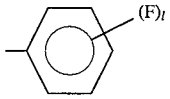

(10)

-continued
(11)
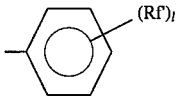
wherein $R_f$ represents any one of the above-described groups of from (1) to (8); n represents an integer of from 1 to 18; m represents an integer of from 1 to 18; and l represents an integer of from 1 to 5.
(s-1)
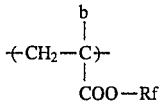
(s-2)
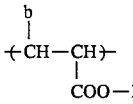
(s-3)
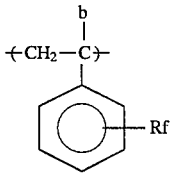
(s-4)
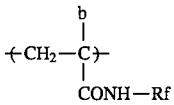
(s-5)
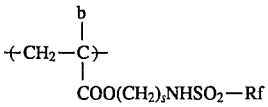
(s: an integer of from 1 to 12)
(s-6)
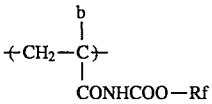
(s-7)
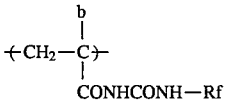
(s-8)
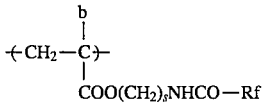
(s-9)
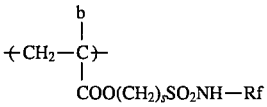
(s-10)
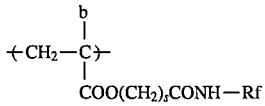
(s-11)
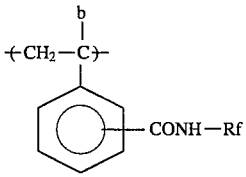
-continued
(s-12)
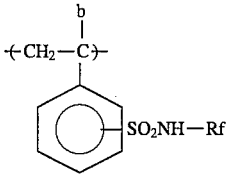
(s-13)
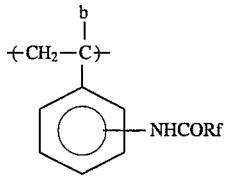
(s-14)
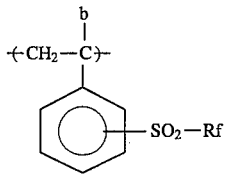
(s-15)
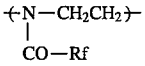
(s-16)
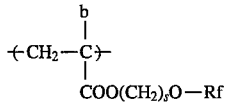
(s-17)
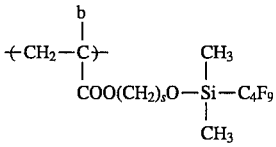
(s-18)
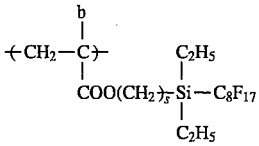
(s-19)
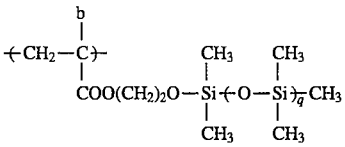
q: an integer of from 1 to 20
(s-20)
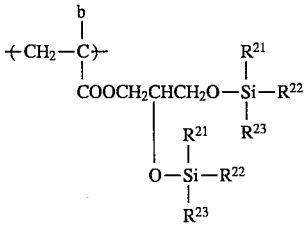
$R^{21}$, $R^{22}$, $R^{23}$: an alkyl group having from 1 to 12 carbon atoms
(s-21)
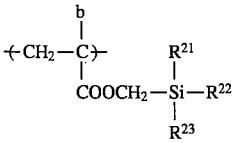

-continued (s-22)

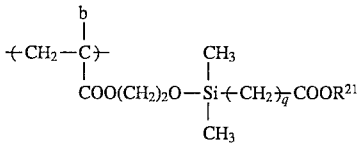

(s-23)

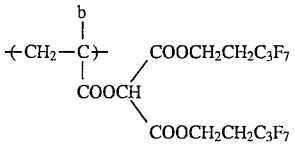

(s-24)

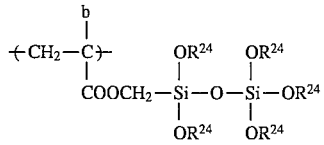

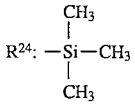

(s-25)

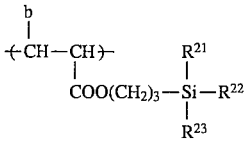

(s-26)

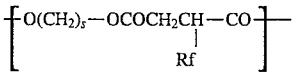

(s-27)

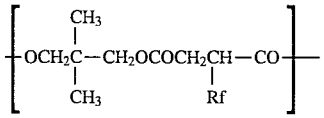

(s-28)

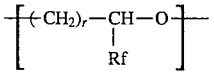

r: an integer of from 3 to 6

(s-29)

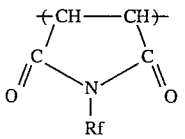

(s-30)

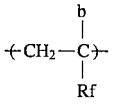

(s-31)

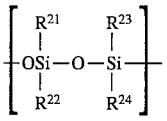

(s-32)

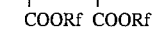

The polymer components (s) described above are preferably present as a block in the thermoplastic resin. The thermoplastic resin may be any type of copolymer as far as it contains the fluorine atom and/or silicon atom-containing polymer components (s) as a block. The term "to be contained as a block" means that the thermoplastic resin has a polymer segment comprising at least 70% by weight of the fluorine atom and/or silicon atom-containing polymer component based on the weight of the polymer segment. The content of polymer components (s) present in the polymer segment constituting a block is preferably 90% by weight, more preferably 100% by weight. The forms of blocks include an A-B type block, an A-B-A type block, a B-A-B type block, a grafted type block, and a starlike type block as schematically illustrated below.

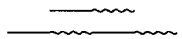

A-B Type

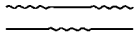

A-B-A (B-A-B) Type

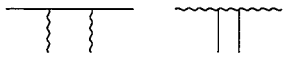

Graft Type (The number of the grafts is arbitrary)

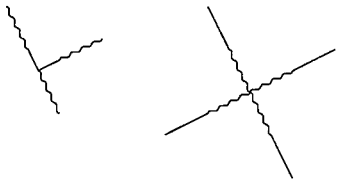

Starlike Type (The number of the grafts is arbitrary)

— : Segment A (containing fluorine atom and/or silicon atom)

~~ : Segment B (containing no or little fluorine atom and/or silicon atom)

These various types of block copolymers of the thermoplastic resins can be synthesized in accordance with conventionally known polymerization methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (N.Y.) (1987), Yoshio Okamoto, *Kobunshi*, Vol. 38, P. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higasimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Hirmori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechanochemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C. M. C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (N.Y.) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A. C. S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers of the thermoplastic resins according to the present invention is not limited to these methods.

The thermoplastic resins (AH) and (AL) are preferably used at least 70% by weight, more preferably at least 90% by weight based on the total amount of the composition for the transfer layer.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, micro-crystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer may be composed of two or more layers, if desired. In such a case, the thermoplastic resins (AH) and/or (AL) should be present at least in a layer which is in contact with the surface of the electrophotographic light-sensitive element. In accordance with a preferred embodiment, the transfer layer is composed of a lower layer which is contact with the surface of the electrophotographic light-sensitive element and which comprises a thermoplastic resin having a relatively high glass transition point or softening point, for example, one of the thermoplastic resins (AH) described above, and an upper layer provided thereon comprising a thermoplastic resin having a relatively low glass transition point or softening point, for example, one of the thermoplastic resins (AL) described above, and in which the difference in the glass transition point or softening point therebetween is at least 2° C., and preferably at least 5° C. By introducing such a configuration of the transfer layer, transferability of the transfer layer to a receiving material is remarkably improved, a further enlarged latitude of transfer conditions (e.g., heating temperature, pressure, and transportation speed) can be achieved, and the transfer can be easily performed irrespective of the kind of receiving material. Moreover, the above-described filing property is more improved since the surface of the transfer layer transferred onto a receiving material is composed of the thermoplastic resin having a relatively high glass transition point or softening point, and the retouching property and sealing property similar to those of normal paper may be imparted to the resulting color duplicate by appropriately selecting the thermoplastic resins (AH).

The transfer layer suitably has a thickness of from 0.2 to 20 μm, and preferably from 0.5 to 10 μm. If the transfer layer is too thin, it is liable to result in insufficient transfer, and if the layer is too thick, troubles on the electrophotographic process tend to occur, failing to obtain a sufficient image density or resulting in degradation of image quality. When the transfer layer is composed of a plurality of layers, a thickness of a single layer is at least 0.1 μm while the thickness of the total layers is usually at most 20 μm.

According to the present invention, there is also provided a method of forming an electrophotographic color transfer image comprising forming a transfer layer which mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C. on a surface of an electrophotographic light-sensitive element which surface has an adhesive strength of not more than 200 gram.force, which is measured according to JIS Z 0237-1980 "Testing methods of pressure sensitive adhesive tapes and sheets", forming at least one color toner image on the transfer layer by an electrophotographic process and heat-transferring the toner image together with the transfer layer onto a receiving material, and wherein the electrophotographic light-sensitive element is repeatedly usable.

According to this embodiment, since the transfer layer is formed each time on the light-sensitive element, the light-sensitive element can be repeatedly employed after the transfer layer is released therefrom. Therefore, it is advantageous in that the formation and release of the transfer layer can be performed in sequence with the electrophotographic process in an electrophotographic color image-forming apparatus without throwing the light-sensitive element away after using it only once.

In order to form the transfer layer in the present invention, conventional layer-forming methods can be employed. For instance, a solution or dispersion containing the composition for the transfer layer is applied onto the surface of light-sensitive element in a known manner. In particular, for the formation of transfer layer on the surface of light-sensitive element, a hot-melt coating method, electrodeposition coating method or transfer method is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive drum. Suitable examples of coating machines include a direct roll coater, an offset gravure roll coater, a rod coater, an extrusion coater, a slot orifice coater, and a curtain coater.

A melting temperature of the thermoplastic resin at coating is usually in a range of from 50° to 180° C., while the optimum temperature is determined depending on the composition of the thermoplastic resin to be used. It is preferred that the resin is first molten using a closed pre-heating device having an automatic temperature controlling means and then heated in a short time to the desired temperature in a position to be coated on the light-sensitive element. To do so can prevent from degradation of the thermoplastic resin upon thermal oxidation and unevenness in coating.

A coating speed may be varied depending on flowability of the thermoplastic resin at the time of being molten by heating, a kind of coater, and a coating amount, etc., but is suitably in a range of from 1 to 100 mm/sec, preferably from 5 to 40 mm/sec.

Now, the electrodeposition coating method will be described below. According to this method, the thermoplastic resin is electrostatically adhered or electrodeposited (hereinafter simply referred to as electrodeposition sometimes) on the surface of light-sensitive element in the form of resin grains and then transformed into a uniform thin film, for example, by heating, thereby the transfer layer being formed. Grains of thermoplastic resin (AH) and (AL) are sometimes referred to as resin grain (ARH) and (ARL), respectively hereinafter.

The thermoplastic resin grains must have either a positive charge or a negative charge. The electroscopicity of the resin grains is appropriately determined depending on a charging property of the electrophotographic light-sensitive element to be used in combination.

The thermoplastic resin grains may contain two or more thermoplastic resins, if desired. For instance, when a combination of resins, for example, those selected from the thermoplastic resins (AH) and (AL), whose glass transition points or softening points are different at least 2° C., preferably at least 5° C. from each other is used, improvement in transferability of the transfer layer formed therefrom to a receiving material and an enlarged latitude of transfer conditions can be achieved. In such a case, these resins may be present as a mixture in the grains or may form a layered structure such as a core/shell structure wherein a core part and a shell part are composed of different resins respectively. Resin grains having a core/shell structure wherein the core part is composed of one of the resins (AL) and (AH) and the shell part is composed of the other resin are preferred to form the transfer layer since the transfer onto a receiving material can be rapidly performed under mild conditions.

An average grain diameter of the resin grains having the physical property described above is generally in a range of from 0.01 to 15 μm, preferably from 0.05 to 5 μm and more preferably from 0.1 to 1 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C. M. C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K.E.J. Barrett, *Dispersion Polymerization in Organic Media*, John Wiley & Sons (1975).

The resin grains having a core/shell structure described above can also be prepared easily using the polymerization granulation method. Specifically, fine grains composed of the first resin are prepared by a dispersion polymerization method in a non-aqueous system and then using these fine grains as seeds, a monomer corresponding to the second resin is supplied to conduct polymerization in the same manner as above, whereby resin grains having a core part composed of the first resin and a shell part composed of the second resin are obtained.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is usually a non-aqueous solvent having an electric resistance of not less than $10^8$ Ω.cm and a dielectric constant of not more than 3.5, since the dispersion is employed in a method wherein the resin grains are electrodeposited utilizing a wet type electrostatic photographic developing process or electrophoresis in electric fields.

The method in which grains comprising the thermoplastic resin dispersed in an electrical insulating solvent having an electric resistance of not less than $10^8$ Ω.cm and a dielectric constant of not more than 3.5 are supplied is preferred in view of easy preparation of the transfer layer having a uniform and small thickness.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G,. Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω.cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965.

The dispersion of resin grains in a non-aqueous system (latex) which can be employed for electrodeposition usually comprises from 0.1 to 20 g of grains containing the thermoplastic resin, from 0.01 to 50 g of a dispersion stabilizing resin and if desired, from 0.0001 to 10 g of a charge control agent in one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω.cm, a sufficient amount of the thermoplastic resin grains deposited is reluctant to obtain and, hence, it is necessary to control the amounts of these additives in the range of not lowering the electric resistance than $10^8$ Ω.cm.

The thermoplastic resin grains which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains comprising the thermoplastic resin are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to Light, as described in *Denshishashin Gijutsu no Kiso to Oyo*, pp. 46 to 79, mentioned above.

The amount of thermoplastic resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the thermoplastic resin grains in the form of a film, thereby the transfer layer being formed.

Now, the formation of transfer layer by the transfer method will be described below. According to this method, the transfer layer provided on a releasable support typically represented by release paper (hereinafter simply referred to as release paper) is transferred onto the surface of electrophotographic light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/$m^2$.

Release paper for tapes, labels, formation industry use and cast coat industry use each manufactured by a paper making company and put on sale are also generally employed. Specific examples thereof include Separate Shi (manufactured by Ohji Seishi K. K.), King Rease (manufactured by Shikoku Seishi K. K.), Sun Release (manufactured by Sanyo Kokusaku Pulp K. K.) and NK High Release (manufactured by Nippon Kako Seishi K. K.).

In order to form the transfer layer on release paper, a composition for the transfer layer mainly composed of the thermoplastic resins (AH) and (AL) are applied to releasing paper in a conventional manner, for example, by bar coating, spin coating or spray coating to form a film. The transfer layer may also be formed on release paper by a hot-melt coating method or an electrodeposition coating method.

For a purpose of heat transfer of the transfer layer on release paper to the electrophotographic light-sensitive element, conventional heat transfer methods are utilized. Specifically, release paper having the transfer layer thereon is pressed on the electrophotographic light-sensitive element to heat transfer the transfer layer. For instance, a device shown in FIG. 5 is employed for such a purpose. In FIG. 5, release paper 10 having thereon the transfer layer 12 comprising the thermoplastic resins (AH) and (AL) is heat-pressed on the light-sensitive element by a heating roller 117*b*, thereby the transfer layer 12 being transferred on the surface of light-sensitive element 11. The release paper 10 is cooled by a cooling roller 117*c* and recovered. The light-sensitive element is heated by a pre-heating means 17*a* to improve transferability of the transfer layer 12 upon heat-press, if desired.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to the receiving material.

Now, the electrophotographic light-sensitive element on the surface of which the transfer layer is formed will be described in detail below.

Any conventionally known electrophotographic light-sensitive element can be employed as far as the surface of the light-sensitive element has the specified releasability so as to easily release the transfer layer provided thereon.

More specifically, an electrophotographic light-sensitive element wherein an adhesive strength of the surface thereof measured according to JIS Z 0237-1980 "Testing methods of pressure sensitive adhesive tapes and sheets" is not more than 200 gram.force is employed.

The measurement of adhesive strength is conducted according to JIS Z 0237-1980 8.3.1. 180 *Degrees Peeling Method* with the following modifications:

(i) As a test plate, an electrophotographic light-sensitive element comprising a substrate and a photoconductive layer, on the surface of which a transfer layer is to be provided is used.

(ii) As a test piece, a pressure resistive adhesive tape of 6 mm in width prepared according to JIS C-2338 is used.

(iii) A peeling rate is 120 mm/min using a constant rate of traverse type tensile testing machine.

Specifically, the test piece is laid its adhesive face downward on the cleaned test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The adhesive strength of the surface of electrophotographic light-sensitive element is preferably not more than 150 gram.force, and more preferably not more than 80 gram.force.

One example of the electrophotographic light-sensitive element, the surface of which has the releasability is an electrophotographic light-sensitive element using amorphous silicon as a photoconductive substance. Another example thereof wherein a photoconductive substance other than amorphous silicon is used is an electrophotographic light-sensitive element comprising a photoconductive layer and a separate layer (hereinafter expediently referred to as an overcoat layer sometimes), the surface of which has the releasability provided thereon, or an electrophotographic light-sensitive element in which the surface of the uppermost layer of a photoconductive layer (including a single photoconductive layer and a laminated photoconductive layer) is modified so as to exhibit the releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type copolymer) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-61-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Application No. 534,479A1.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in European Patent Application No. 534,279A1. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive material according to the present invention include a resin (P) and resin grains (L).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (A) containing at least 50% by weight of a fluorine atom and/or silicon atom-containing polymer component and at least one polymer segment (B) containing 0 to 20% by weight of a fluorine atom and/or silicon atom-containing polymer component, the polymer segments (A) and (B) being bonded in the form of blocks. More preferably, the polymer segment (B) of the block copolymer contains at least one polymer component containing at least one photo- and/or heat-curable functional group.

It is preferred that the polymer segment (B) does not contain any fluorine atom and/or silicon atom-containing polymer component.

As compared with the random copolymer, the block copolymer comprising the polymer segments (A) and (B) (surface-localized type copolymer) is more effective not only for improving the surface releasability but also for maintaining such a releasability.

More specifically, where a film is formed in the presence of a small amount of the resin or resin grains of copolymer containing a fluorine atom and/or a silicon atom, the resins (P) or resin grains (L) easily migrate to the surface portion of the film and are concentrated there by the end of a drying step of the film to thereby modify the film surface so as to exhibit the releasability.

Where the resin (P) is the block copolymer in which the fluorine atom and/or silicon atom-containing polymer segment exists as a block, the other polymer segment containing no, or if any a small proportion of, fluorine atom and/or silicon atom-containing polymer component undertakes sufficient interaction with the film-forming binder resin since it has good compatibility therewith. Thus, during the formation of the transfer layer on the light-sensitive element, further migration of the resin into the transfer layer is inhibited or prevented by an anchor effect to form and maintain the definite interface between the transfer layer and the photoconductive layer.

Further, where the segment (B) of the block copolymer contains a photo- and/or heat-curable group, crosslinking between the polymer molecules takes place during the film formation to thereby ensure retention of the releasability at the interface between the light-sensitive element and the transfer layer.

The above-described polymer may be used in the form of resin grains as described above. Preferred resin grains (L) are resin grains dispersible in a non-aqueous solvent. Such resin grains include a block copolymer comprising a non-aqueous solvent-insoluble polymer segment which contains a fluorine atom and/or silicon atom-containing polymer component and a non-aqueous solvent-soluble polymer segment which contains no, or if any not more than 20% of, fluorine atom and/or silicon atom-containing polymer component.

Where the resin grains according to the present invention are used in combination with a binder resin, the insolubilized polymer segment undertakes migration of the grains to the surface portion and concentration there while the soluble polymer segment exerts an interaction with the binder resin (an anchor effect) similarly to the above-described resin. When the resin grains contain a photo- and/or heat-curable group, further migration of the grains to the transfer layer can be avoided.

The moiety having a fluorine atom and/or a silicon atom contained in the resin (P) or resin grains (L) includes that incorporated into the main chain of the polymer and that contained as a substituent in the side chain of the polymer.

The polymer component containing a moiety having a fluorine atom and/or a silicon atom used is the same as the polymer component (s) described with respect to the thermoplastic resins (AH) and (AL) hereinbefore.

Of the resins (P) and resin grains (L) each containing silicon atom and/or fluorine atom used in the uppermost layer of the electrophotographic light-sensitive element according to the present invention, the so-called surface-localized type copolymers will be described in detail below.

The content of the silicon atom and/or fluorine atom-containing polymer component in the segment (A) is at least 50% by weight, preferably at least 70% by weight, and more preferably at least 80% by weight. The content of the fluorine atom and/or silicon atom-containing polymer component in the segment (B) bonded to the segment (A) is not more than 20% by weight, and preferably 0% by weight.

A weight ratio of segment (A) segment (B) ranges usually from 1/99 to 95/5, and preferably from 5/95 to 90/10. If the weight ratio is out of this range, the migration effect and anchor effect of the resin (P) or resin grain (L) at the surface region of light-sensitive element are decreased and, as a result, the releasability in order to peel the transfer layer is reduced.

The resin (P) preferably has a weight average molecular weight of from $5\times10^3$ to $1\times10^6$, and more preferably from $1\times10^4$ to $5\times10^5$. The segment (A) in the resin (P) preferably has a weight average molecular weight of at least $1\times10^3$.

The resin grain (L) preferably has an average grain diameter of from 0.001 to 1 μm, and more preferably from 0.05 to 0.5 μm.

A preferred embodiment of the surface-localized type copolymer in the resin (P) according to the present invention will be described below. Any type of the block copolymer can be used as far as the fluorine atom and/or silicon atom-containing polymer components are contained therein as a block. The term "to be contained as a block" means that the polymer has the polymer segment containing at least 50% by weight of the fluorine atom and/or silicon atom-containing polymer component based on the weight of the polymer segment. The forms of blocks include an A-B type block, an A-B-A type block, a B-A-B type block, a grafted type block, and a starlike type block as described with respect to the resins (AH) and (AL) above.

These various types of block copolymers of the resins (P) can be synthesized in accordance with conventionally known polymerization methods. Specifically, methods described for the thermoplastic resins (AH) and (AL) containing the polymer components (s) as a block can be employed.

A preferred embodiment of the resin grains (L) according to the present invention will be described below. As described above, the resin grains (L) preferably comprises the fluorine atom and/or silicon atom-containing polymer segment (A) insoluble in a non-aqueous solvent and the polymer segment (B) which is soluble in a non-aqueous solvent and contains substantially no fluorine atom and/or silicon atom, and have an average grain diameter of not more than 1 μm. The polymer segment (A) constituting the insoluble portion of the resin grain may have a crosslinked structure.

Preferred methods for synthesizing the resin grains (L) described above include the non-aqueous dispersion polymerization method hereinbefore described with respect to the non-aqueous solvent-dispersed thermoplastic resin grains. Specific examples of the methods described above are also applied to the resin grains (L).

The non-aqueous solvents which can be used in the preparation of the non-aqueous solvent-dispersed resin grains include any organic solvents having a boiling point of not more than 200° C., either individually or in combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

Dispersion polymerization in such a non-aqueous solvent system easily results in the production of mono-dispersed resin grains having an average grain diameter of not greater than 1 μm with a very narrow size distribution.

More specifically, a monomer corresponding to the polymer component constituting the segment (A) (hereinafter referred to as a monomer (a)) and a monomer corresponding to the polymer component constituting the segment (B) (hereinafter referred to as a monomer (b)) are polymerized by heating in a non-aqueous; solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (B) (hereinafter referred to as a polymer (PB)) are polymerized in the same manner as described above.

The inside of the polymer grain (L) according to the present invention may have a crosslinked structure. The formation of crosslinked structure can be conducted by any of conventionally known techniques. For example, (i) a method wherein a polymer containing the polymer segment (A) is crosslinked in the presence of a crosslinking agent or a curing agent; (ii) a method wherein at least the monomer (a) corresponding to the polymer segment (A) is polymerized in the presence of a polyfunctional monomer or oligomer containing at least two polymerizable functional groups to form a network structure over molecules; or (iii) a method wherein the polymer segment (A) and a polymer containing a reactive group-containing polymer component are subjected to a polymerization reaction or a polymer reaction to cause crosslinking may be employed.

The crosslinking agents to be used in the method (i) include those commonly employed as described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kiso-hen*), Baifukan (1986).

Specific examples of suitable crosslinking agents include organosilane compounds (such as those known as silane coupling agents, e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (ii) above include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

The monomer or oligomer containing two or more polymerizable functional groups is used in an amount of not more than 10 mol%, and preferably not more than 5 mol%, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (iii), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (ii) using a polyfunctional monomer is preferred for the formation of network structure. Specifically, a monomer (a), a monomer (b) and/or a polymer (PB) and, in addition, a polyfunctional monomer (d) are subjected to polymerization granulation reaction to obtain resin grains. Where the above-described polymer (PB) comprising the segment (B) is used, it is preferable to use a polymer (PB') which has a polymerizable double bond group copolymerizable with the monomer (a) in the side chain or at one terminal of the main chain of the polymer (PB).

The polymerizable double bond group is not particularly limited as far as it is copolymerizable with the monomer (a). Specific examples thereof include

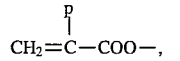

$CH_2{=}C(p){-}COO{-}$, $C(CH_3)H{=}CH{-}COO{-}$, $CH_2{=}C(CH_2COOH){-}COO{-}$,

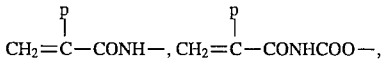

$CH_2{=}C(p){-}CONH{-}$, $CH_2{=}C(p){-}CONHCOO{-}$,

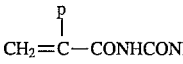

$CH_2{=}C(p){-}CONHCONH{-}$, $C(CH_3)H{=}CH{-}CONH{-}$, $CH_2{=}CHCO{-}$, $CH_2{=}CH(CH_2)_n{-}OCO{-}$, $CH_2{=}CHO{-}$, and $CH_2{=}CH{-}C_6H_4{-}$, wherein p represents —H or —$CH_3$, and n represents 0 or an integer of from 1 to 3.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group in the block copolymer (P) ranges from 0.1 to 40 parts by weight, and preferably from 1 to 30 parts by weight, based on 100 parts by weight of the polymer segment (B) therein.

If the content is less than 0.1 part by weight, curing of the photoconductive layer after film formation does not proceed sufficiently, sometimes resulting in insufficient maintenance of the interface between the photoconductive layer and the transfer layer formed thereon, and thus giving adverse influences on the peeling off of the transfer layer. If the content exceeds 40 parts by weight, the electrophotographic characteristics of the photoconductive layer are deteriorated, sometimes resulting in reduction in reproducibility of original in duplicated image and occurrence of background fog in non-image areas.

The photo- and/or heat-curable group-containing block copolymer (P) is preferably used in an amount of not more than 40% by weight based on the total binder resin. If the proportion of the resin (P) is more than 40% by weight, the electrophotographic characteristics of the light-sensitive element tend to be deteriorated.

The fluorine atom and/or silicon atom-containing resin may also be used in combination with the photo- and/or heat-curable resin (D) in the present invention. The photo- and/or heat-curable group in the resin (D) is not particularly limited and includes those described with respect to the block copolymer above.

Any of conventionally known curable resins may be used as the photo- and/or heat-curable resin (D). For example, resins containing the curable group as described with respect to the block copolymer (P) may be used.

Further, conventionally known binder resins for an electrophotographic light-sensitive layer are employed. These resins are described, e.g., in Takaharu Shibata and Jiro Ishiwatari, *Kobunshi*, Vol. 17, p. 278 (1968), Harumi Miyamoto and Hidehiko Takei, Imaging, Vol. 1973, No. 8, Koichi Nakamura (ed.), *Kiroku Zairyoyo Binder no Jissai Gijutsu*, Ch. 10, C. M. C. (1985), Denshishashin Gakkai (ed.), *Denshishashinyo Yukikankotai no Genjo Symposium* (preprint) (1985), Hiroshi Kokado (ed.), *Saikin no Kododenzairyo to Kankotai no Kaihatsu.Jitsuyoka*, Nippon Kagaku Joho (1986), Denshishashin Gakkai (ed.), *Denshishashin*

*Gijutsu no Kiso To Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshishashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka*, C. M. C. (1986), Yuji Harasaki, *Saishin Binder Gijutsu Binran*, Ch. II-1, Sogo Gijutsu Center (1985), Takayuki Otsu, *Acryl Jushi no Gosei.Sekkei to Shinyoto Kaihatsu*, Chubu Kei-ei Kaihatsu Center Shuppanbu (1985), and Eizo Omori, *Kinosei Acryl-Kei Jushi*, Techno System (1985).

As described above, while the overcoat layer or the photoconductive layer contains the silicon atom and/or fluorine atom-containing block copolymer (P) and, if desired, other binder resins, it is preferred that the layer further contains a small amount of photo- and/or heat-curable resin (D) and/or a crosslinking agent for further improving film curability.

The amount of photo- and/or heat-curable resin (D) and/or crosslinking agent to be added is from 0.01 to 20% by weight, and preferably from 0.1 to 15% by weight, based on the total amount of the whole resin. If the amount is less than 0.01% by weight, the effect of improving film curability decreases. If it exceeds 20% by weight, the electrophotographic characteristics may be adversely affected.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kisohen*), Baifukan (1986).

Specific examples of suitable crosslinking agents include organosilane compounds (such as those known as silane coupling agents, e.g., vinyltrimethoxysilane, vinyltributoxysilane, γ-glycidoxypropyltrimethoxysilane, γ-mercaptopropyltriethoxysilane, and γaminopropylethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, a polyoxyethylene glycol, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltrisstearoyl titanate), aluminum coupling compounds (e.g., aluminum butylate, aluminum acetylacetate, aluminum oxide octate, and aluminum trisacetylacetate), polyepoxy-containing compounds and epoxy resins (e.g., the compounds as described in Hiroshi Kakiuchi (ed.), *Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly-(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)). In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the photoconductive layer (a layer which will be in contact with the transfer layer) is preferably cured after film formation. It is preferred that the binder resin, the block copolymer (P), the curable resin (D), and the crosslinking agent to be used in the photoconductive layer are so selected and combined that their functional groups easily undergo chemical bonding to each other.

Combinations of functional groups which easily undergo a polymer reaction are well known. Specific examples of such combinations are shown in Table A below, wherein a functional group selected from Group A can be combined with a functional group selected from Group B. However, the present invention should not be construed as being limited thereto.

TABLE A

| Group A | Group B |
|---|---|
| $-COOH$, $-PO_3H_2$, $-OH$, $-SH$, $-NH_2$, $-NHR$, $-SO_2H$ | 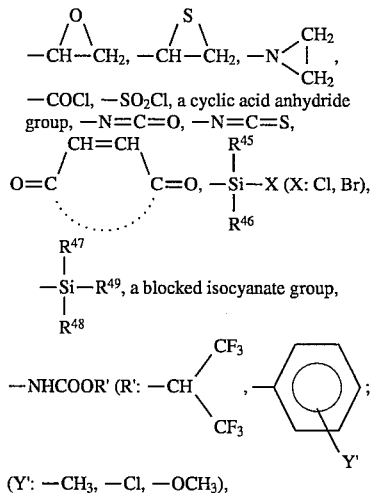 |

TABLE A-continued

| Group A | Group B |
|---|---|
| | —NHCOCH ($B^1$, $B^2$: an electron attracting group), $B^1$, $B^2$ |
| | —NHCO—N=C (e.g., an imidazole ring) |

In Table A, $R^{45}$ and $R^{46}$ each represents an alkyl group; $R^{47}$, $R^{48}$, and $R^{49}$ each represents an alkyl group or an alkoxy group, provided that at least one of them is an alkoxy group; R represents a hydrocarbon group; $B^1$ and $B^2$ each represents an electron attracting group, e.g., —CN, —$CF_3$, —$COR^{50}$, —$COOR^{50}$,—$SO_2OR^{50}$ ($R^{50}$ represents a hydrocarbon group, e.g., —$C_nH_{2n+1}$ (n: an integer of from 1 to 4), —$CH_2C_6H_5$, or —$C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids ( e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

The photoconductive substances for the electrophotographic light-sensitive element which can be used in the present invention are not particularly limited, and any know-n photoconductive substances may be employed. Suitable photoconductive substances are described, e.g., in Denshishashin Gakkai (ed.), *Denshishashin Gijutsu no Kiso to Oyo*, Corona Sha (1988) and Hiroshi Kokado (ed.), *Saikin no Kododen Zairyo to Kankotai no Kaihatsu.Jitsuyoka*, Nippon Kagaku Joho (1985).

Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U. S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k)

styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

The binder resins which can be used in the light-sensitive element according to the present invention include those for conventionally known electrophotographic light-sensitive elements. A preferred weight average molecular weight of the binder resin is from $5\times10^3$ to $1\times10^6$, and particularly from $2\times10^4$ to $5\times10^5$. A preferred glass transition point of the binder resin is from −40° to 200° C. and particularly from −10° to 140° C.

Conventional binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kioku Zairyoyo Binder no Jissai Gijutsu*, Ch. 10, C. M. C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu.Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Further, the electrostatic characteristics of the photoconductive layer are improved by using, as a binder resin, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a medium to high molecular weight resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5043, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent that the in characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

As described above, the electrophotographic light-sensitive element of the present invention is characterized in that its surface in contact with the transfer layer has the specified releasability.

The electrophotographic light-sensitive material suitable for the preparation of a color transfer image according to the present invention is characterized by comprising an electrophotographic light-sensitive element which comprises a conductive support having thereon an electrophotographic light-sensitive layer and the surface of which has the specified releasability and having on the surface a peelable transfer layer which is mainly composed of the thermoplastic resins (AH) and (AL). After the transfer layer is released from the electrophotographic light-sensitive element, the latter can be repeatedly used upon providing again a transfer layer thereon.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu.Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The receiving material used in the present invention is not particularly limited and any material conventionally known can be employed. Suitable examples of the receiving materials include those of reflective type, for example, natural paper such as high quality paper, coated paper or art paper, synthetic paper, a metal plate such as an aluminum, iron or SUS plate, and those of transmittive type, for example, a plastic film such as a polyester, polyolefin, polyvinyl chloride or polyacetate film.

In order to prepare a color transfer image according to the present invention, a duplicated image is first formed through a conventional electrophotographic process. Specifically, each step of charging, light exposure, development and fixing is performed in a conventionally known manner. Particularly, a combination of a scanning exposure system using a laser beam based on digital information and a development system using a liquid developer is an advantageous process since the process is particularly suitable to form highly accurate images.

One specific example of the methods for preparing a color transfer image is illustrated below. An electrophotographic light-sensitive material is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seq., Corona Sha (1988). A corotron or scotron system is usually used for the charging process. In a preferred charging process, the charging conditions may be controlled by a feedback system of the information on charged potential from a detector connected to the light-sensitive material thereby to control the surface potential within a predetermined range.

Thereafter, the charged light-sensitive material is exposed to light by scanning with a laser beam in accordance with the system described, for example, in ibidem, p. 254 et seq. Of four color separation images, first the image corresponding to a yellow part is converted to a dot pattern and exposed.

Toner development is then conducted using a liquid developer. The light-sensitive material charged and exposed is removed from the flat bed and developed according to a wet type developing method as described, for example, in ibidem, p. 275 et seq. The exposure mode is determined in accord with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to ibidem, p. 157 et seq.

After the toner development, the light-sensitive material is squeezed to remove the excess developer as described in ibidem, p. 283 and dried. Preferably, the light-sensitive material may be rinsed with the carrier liquid used in the liquid developer before squeezing.

The above electrophotographic process for forming toner image is repeated with respect to a magenta, cyan and black part in case forming a full-color duplicate.

The thus-formed toner image on the light-sensitive material is then heat-transferred to a receiving material together with the transfer layer.

The heat-transfer of the toner image together with the transfer layer onto a receiving material can be performed using known methods and apparatus.

Figure 2:
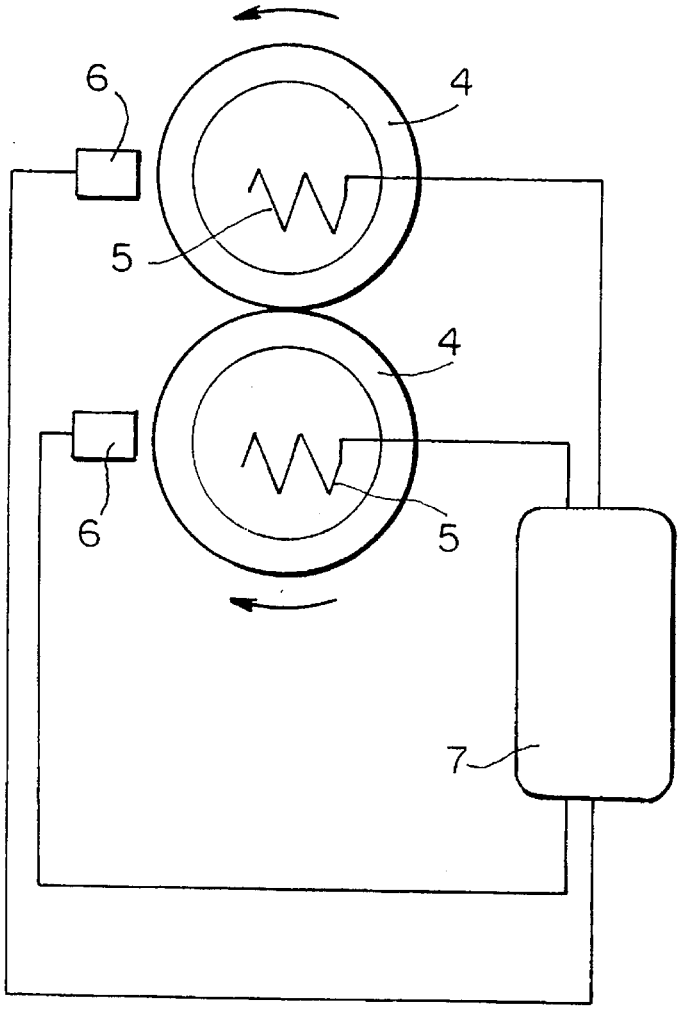
FIG. 2 is a schematic view of an apparatus for heat-transfer of transfer layer to a receiving material.

An example of the apparatus for transferring the transfer layer with the toner image thereon to a receiving material is illustrated in FIG. 2. The apparatus is composed of a pair of rollers covered with rubber 4 each containing therein a heating means 5 which are driven with a predetermined nip pressure applied. The surface temperature of rollers 4 is preferably in a range of from 50° to 150° C., and more preferably from 80° to 120° C., the nip pressure between rollers 4 is preferably in a range of from 0.2 to 20 kgf/cm$^2$, and more preferably from 0.5 to 10 kgf/cm$^2$, and the transportation speed is preferably in a range of from 0.1 to 100 mm/sec, and more preferably from 1 to 30 mm/sec. As a matter of course, these conditions should be optimized according to the physical properties of the transfer layer and light-sensitive element of the light-sensitive material and the receiving material each employed.

The temperature of roller surface is preferably maintained within a predetermined range by means of a surface temperature detective means 6 and a temperature controller 7. A pre-heating means and a cooling means for the light-sensitive material may be provided in front of and at the rear of the heating roller portion, respectively. Although not shown in FIG. 2, as a means for pressing two rollers, a pair of springs provided at both ends of the shaft of at least one roller or an air cylinder using compressed air may be employed.

The method for preparation of a color duplicate according to the present invention will be described as well as an electrophotographic color transfer image-forming apparatus useful for carrying out the method with reference to the accompanying drawings, hereinbelow.

Figure 3:
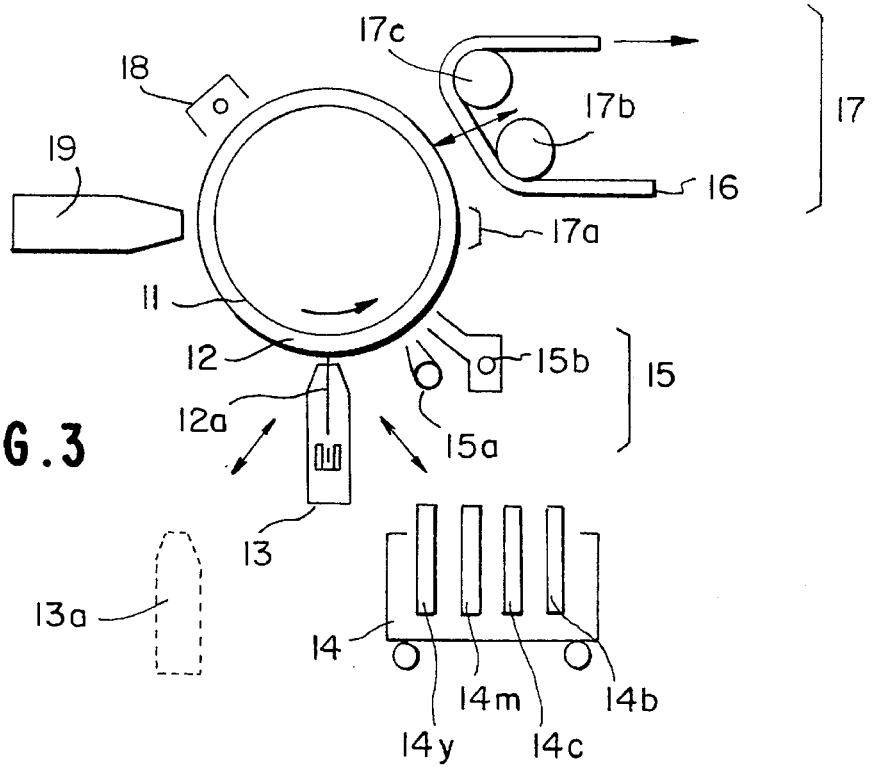
FIG. 3 is a schematic view of an electrophotographic color transfer image-forming apparatus using a hot-melt coating method for the formation of transfer layer.

FIG. 3 is a schematic view of an electrophotographic color transfer image-forming apparatus suitable for carrying out the method of the present invention. In this example, the transfer layer is formed by the hot-melt coating method.

Thermoplastic resin 12*a* is coated to form a transfer layer 12 on the surface of a light-sensitive element 11 provided on the peripheral surface of a drum by a hot-melt coater 13 and is caused to pass under a suction/exhaust unit 15 to be cooled to a predetermined temperature. After the hot-melt coater 13 is moved to the stand-by position indicated as 13*a*, a liquid developing unit set 14 is moved to the position where the hot-melt coater 13 was. The unit set 14 is provided with a developing units 14*y*, 14*m*, 14*c* and 14*b* containing yellow, magenta, cyan and black liquid developers respectively.

Each of the developing unit may be equipped with a pre-bathing means, a rinsing means and a squeezing means in order to prevent the occurrence of stain in the non-image areas, if desired. As the pre-bath and the rinse solution, a carrier liquid for a liquid developer is conventionally used.

The light-sensitive element 11 bearing thereon the transfer layer 12 of the thermoplastic resin is then subjected to the electrophotographic process. Specifically, when it is uniformly charged to, for instance, a positive polarity by a corona charger 18 and then is exposed imagewise by an exposure device (e.g., a semiconductor laser) 19 on the basis of yellow image information, the potential is lowered in the exposed regions and thus, a contrast in potential is formed between the exposed regions and the unexposed regions. The yellow liquid developing unit 14*y* containing a liquid developer comprising yellow pigment particles having a positive electrostatic charge dispersed in an electrically insulating liquid is brought near the surface of a light-sensitive material and is kept stationary with a gap of 1 mm therebetween.

The light-sensitive material is first pre-bathed by a pre-bathing means provided in the developing unit, and then the yellow liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer is subsequently washed off by a rinsing means of the developing unit and the rinse solution adhering to the surface of the light-sensitive material is removed by a squeeze means. Then, the light-sensitive material is dried by passing under the suction/exhaust unit 15. The above described electrophotographic process is repeated with respect to each image information of magenta, cyan and black. Meanwhile a heat transfer means 17 is kept away from the surface of the light-sensitive material.

After the images are formed on the transfer layer, the transfer layer is pre-heated by a pre-heating means 17*a* and is pressed against a rubber roller 17*b* having therein a heater with a temperature control means with the receiving material 16 intervening therebetween. The transfer layer and the receiving material are then passed under a cooling roller 17*c*, thereby heat-transferring the toner image to the receiving material together with the transfer layer. Thus a cycle of steps is terminated.

The heat transfer means 17 for heating-transferring the transfer layer to the receiving material such as printing paper comprises the pre-heating means 17*a*, the heating roller 17*b* which is in the form of a metal roller having therein a heater and is covered with rubber, and the cooling roller 17*c*. As the preheating means 17*a*, a non-contact type heater such as an infrared line heater, a flash heater or the like is used, and the transfer layer is pre-heated in a range below a temperature of the surface of the light-sensitive material achieved with heating by the heating roller 17*b*. The surface temperature of light-sensitive material heated by the heating roller 17*b* is preferably in a range of from 50° to 150° C., and more preferably from 80° to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller 17*c* is maintained within a predetermined range.

The nip pressure of the rollers is preferably in a range of from 0.2 to 20 kgf/cm$^2$ and more preferably from 0.5 to 15 kgf/cm$^2$. Although not shown, the rollers may be pressed by springs provided on opposite ends of the roller shaft or by an air cylinder using compressed air.

A speed of the transportation is suitably in a range of from 0.1 to 100 mm/sec and preferably in a range of from 1 to 30 mm/sec. The speed of transportation may differ between the electrophotographic process and the heat transfer step.

By stopping the apparatus in the state where the transfer layer has been formed, the next operation can start with the electrophotographic process. Thus, a period for warm-up of the apparatus can be shortened at the next operation. Further the transfer layer acts to protect the light-sensitive element and prevent the properties of the light-sensitive element from deteriorating due to environmental influence.

It is needless to say that the above-described conditions should be optimized depending on the physical properties of the transfer layer, the light-sensitive element (i.e., the light-sensitive layer and the support) and the receiving material. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner thereon.

FIG. 6 is a schematic view of another electrophotographic color transfer image-forming apparatus suitable for carrying out the method of the present invention. In this example, the transfer layer is formed by the electrodeposition coating method.

A dispersion 12*b* of thermoplastic resin grains is supplied to an electrodeposition unit 14T provided in a movable liquid developing unit set 14. The electrodeposition unit 14T is first brought near the surface of the light-sensitive element 11 and is kept stationary with a gap of 1 mm therebetween. The light-sensitive element 11 is rotated while supplying the dispersion 12*b* of thermoplastic resin grains into the gap and applying an electric voltage across the gap from an external power source (not shown), whereby the grains are deposited over the entire image-forming areas of the surface of the light-sensitive element 11.

The dispersion 12*b* of thermoplastic resin grains excessively adhered to the surface of the light-sensitive element 11 is removed by a squeezing device built in the electrodeposition unit 14T, and the light-sensitive element is dried by passing under the suction/exhaust unit 15. Then the thermoplastic resin grains are fused by the pre-heating means 17*a* and thus a transfer layer 12 in the form of thermoplastic resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

After moving away the electrodeposition unit 14T, the liquid developing unit set 14 is posited. The unit set 14 is provided with a liquid developing units 14*y*, 14*m*, 14*c* and 14*b* containing yellow, magenta, cyan and black liquid developers respectively. The unit may be provided, if desired, with a pre-bathing means, a rinsing means and a squeeze means in order to prevent stains of the non-image areas. As the pre-bathing solution and the rinse solution, a carrier liquid for the liquid developer is generally used.

Then the electrophotographic process and the transfer process are subsequently effected. These processes are the same as those described above in conjunction with the example where the hot-melt coating method is used. Also, other conditions related to the apparatus are the same as those described above.

Figure 4:
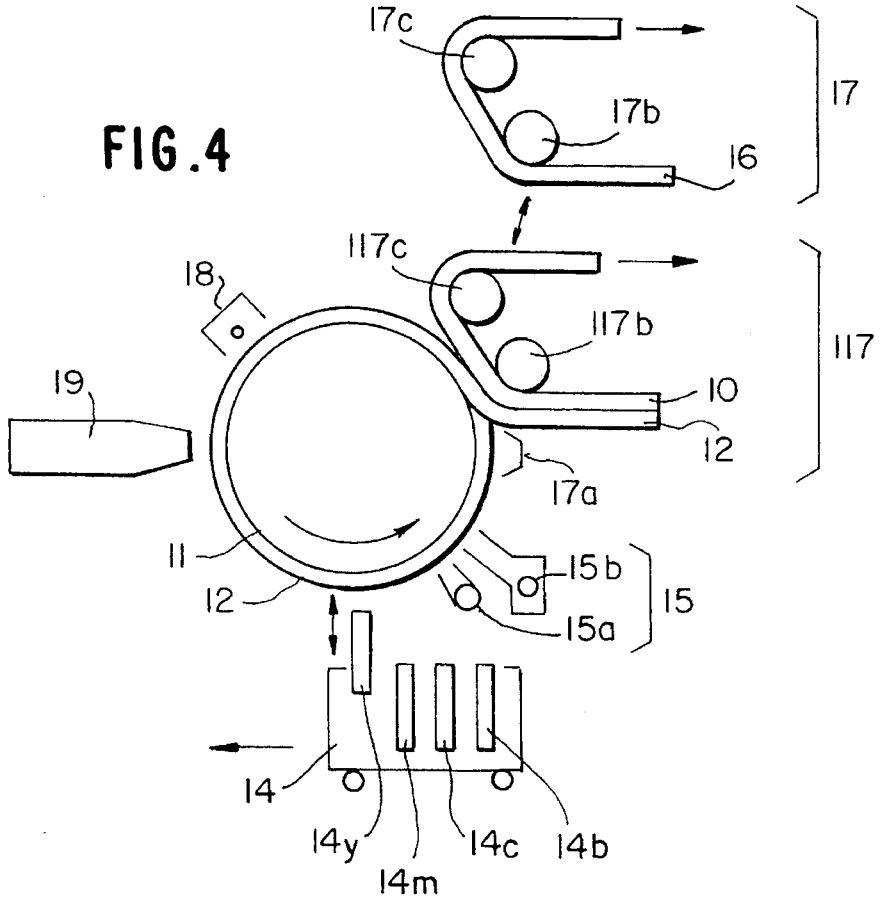
FIG. 4 is a schematic view of an electrophotographic color transfer image-forming apparatus using a transfer method for the formation of transfer layer.

FIG. 4 is a schematic view of still another electrophotographic color transfer image-forming apparatus suitable for carrying out the method of the present invention. In this example, the transfer layer is formed by the transfer method.

The apparatus of FIG. 4 has essentially the same constitution as the apparatus (FIG. 1) used in the hot-melt coating method described above except for means for forming the transfer layer on the surface of light-sensitive element. The electrophotographic process, the transfer process and the conditions thereof performed after forming the transfer layer 12 on the surface of light-sensitive element 11 are also the same as those described above.

In FIG. 4, the apparatus separately provided with a transfer means 117 for transferring the transfer layer 12 from release paper 10 onto the light-sensitive element 11 and a transfer means 17 for transferring the transfer layer having a toner image thereon onto the receiving material 16 is shown. However, a method wherein the transfer layer 12 is first transferred from the release paper 10 to the light-sensitive element using the transfer means 117, a toner image is formed thereon by an electrophotographic process and then the toner image is transferred to the receiving material 16 together with the transfer layer using again the transfer means 117 while now supplying the receiving material 16 can also be employed.

In accordance with the present invention, color images of high accuracy and high quality without color shear are simply and stably obtained. A color duplicate obtained is excellent in storage stability. Transfer of the transfer layer having toner images thereon onto a receiving material can be easily and completely performed. Further, according to the present invention, the transfer layer is easily prepared on a light-sensitive element on demand in an apparatus and the light-sensitive element is repeatedly usable, thereby reducing a running cost.

The present invention is illustrated in greater detail with reference to the following examples, but the present invention is not to be construed as being limited thereto.

Synthesis Examples of Thermoplastic Resin Grain (AR):

SYNTHESIS EXAMPLE 1 OF THERMOPLASTIC RESIN GRAIN (ARH): (ARH-1)

A mixed solution of 10 g of Dispersion Stabilizing Resin (Q-1) having the structure shown below, 100 g of vinyl acetate, and 384 g of Isopar H was heated to a temperature of 70° C. under nitrogen gas stream while stirring. To the solution was added 0.8 g of 2,2'-azobis(isovaleronitrile) (abbreviated as AIVN) as a polymerization initiator, followed by reacting for 3 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours. The temperature was raised to 100° C. and stirred for 2 hours to remove the unreacted vinyl acetate by distillation. After cooling, the reaction mixture was passed through a nylon cloth of 200 mesh to obtain a white dispersion which was a latex of good monodispersity with a polymerization ratio of 90% and an average grain diameter of 0.23 μm. The grain diameter was measured by CAPA-500 manufactured by Horiba Ltd. (hereinafter the same).

A part of the white dispersion was centrifuged at a rotation of $1\times10^4$ r.p.m. for 60 minutes and the resin grains precipitated were collected and dried. A weight average molecular weight (Mw) of the resin grain measured by a GPC method and calculated in terms of polystyrene (hereinafter the same) was $2\times10^5$. A glass transition point (Tg) thereof was 38° C.

Dispersion Stabilizing Resin (Q-1)

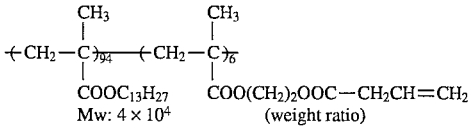

SYNTHESIS EXAMPLE 2 OF THERMOPLASTIC RESIN GRAIN (ARH): (ARH-2)

A mixed solution of 15 g of Dispersion Stabilizing Resin (Q-2) having the structure shown below, 75 g of benzyl methacrylate, 25 g of methyl acrylate, 1.3 g of methyl 3-mercaptopropionate and 552 g of Isopar H was heated to a temperature of 50° C. under nitrogen gas stream while stirring. To the solution was added 1 g of 2,2'-azobis(2-cyclopropylpropionitrile) (abbreviated as ACPP) as a polymerization initiator, followed by reacting for 2 hours. To the reaction mixture was added 0.8 g of ACPP, followed by reacting for 2 hours. Further, 0.8 g of AIVN was added thereto and the reaction temperature was adjusted to 75° C., and the reaction was continued for 3 hours. Then, the temperature was raised to 90° C. and the unreacted monomers were distilled off under a reduced pressure of 20 to 30 mm Hg. After cooling the reaction mixture was passed through a nylon cloth of 200 mesh to obtain a white dispersion which was a latex of good monodispersity with a polymerization ratio of 98% and an average grain diameter of 0.20 μm. An Mw of the resin grain was $2.8\times10^4$ and a Tg thereof was 55° C.

Dispersion Stabilizing Resin (Q-2)

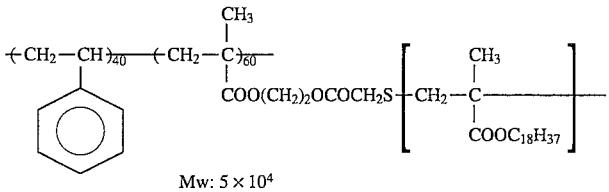

SYNTHESIS EXAMPLE 3 OF THERMOPLASTIC RESIN GRAIN (ARH): (ARH-3)

A mixed solution of 14 g of Dispersion Stabilizing Resin (Q-3) having the structure shown below and 382 g of Isopar G was heated to a temperature of 50° C. under nitrogen gas stream while stirring. To the solution was added dropwise a mixture of 80 g of benzyl methacrylate, 20 g of vinyl toluene and 0.8 g of ACPP over a period of one hour, followed by reacting for one hour. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of AIVN, followed by reacting for 2 hours. Then, the temperature was raised to 100° C., and the unreacted monomers were distilled off under a reduced pressure of 10 to 20 mm Hg. After cooling, the reaction mixture was passed through a nylon cloth of 200 mesh to obtain a white dispersion which was a latex of good monodispersity with a polymerization ratio of 90% and an average grain diameter of 0.17 μm. An Mw of the resin grain was $1\times10^5$ and a Tg thereof was 55° C.

Dispersion Stabilizing Resin (Q-3)

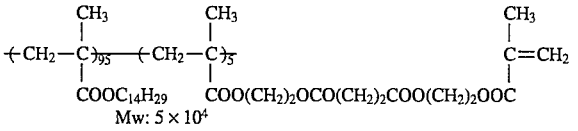

SYNTHESIS EXAMPLE 4 OF THERMOPLASTIC RESIN GRAIN (ARH): (ARH-4)

A mixed solution of 14 g of Dispersion Stabilizing Resin (Q-4) having the structure shown below, 10 g of a monofunctional macromonomer of dimethylsiloxane (Macromonomer (M-1)) (FM-0725 manufactured of Chisso Corp.; a weight average molecular weight (Mw): $1\times10^4$) and 553 g of Isopar H was heated to a temperature of 50° C. under nitrogen gas stream while stirring. To the solution was added dropwise a mixture of 70 g of methyl methacrylate, 20 g of ethyl acrylate, 1.3 g of methyl 3-mercaptopropionate and 1.0 g of ACPP over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of ACPP, followed by reacting for 2 hours. After cooling, the reaction mixture was passed through a nylon cloth of 200 mesh to obtain a white dispersion which was a latex of good monodispersity with a polymerization ratio of 99% and an average grain diameter of 0.15 μm. An Mw of the resin grain was $3\times10^4$ and a Tg thereof was 50° C.

Dispersion Stabilizing Resin (Q-4)

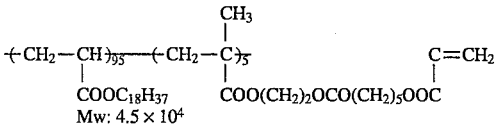

SYNTHESIS EXAMPLES 5 TO 9 OF THERMOPLASTIC RESIN GRAIN (ARH): (ARH-5) TO (ARH-9)

Each of the thermoplastic resin grains (ARH-5) to (ARH-9) was synthesized in the same manner as in Synthesis Examples 4 of Thermoplastic Resin Grain (ARH) except for using each of the macromonomers (Mw thereof being in a range of from $8\times10^3$ to $1\times10^4$) shown in Table B below in place of 10 g of Macromonomer (M-1). A polymerization ratio of each of the resin grains was in a range of from 98 to 99% and an average grain diameter thereof was in a range of from 0.15 to 0.25 μm with good monodispersity. An Mw of each of the resin grains was in a range of from $2.5\times10^4$ to $4\times10^4$ and a Tg thereof was in a range of from 40° C. to 70° C.

TABLE B

| Synthesis Example of Thermoplastic Resin Grain (ARH) | Thermoplastic Resin Grain (ARH) | Macromonomer |
|---|---|---|
| 5 | ARH-5 | 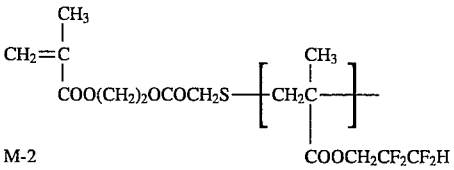 M-2 |
| 6 | ARH-6 | 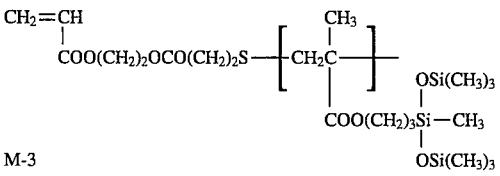 M-3 |
| 7 | ARH-7 | 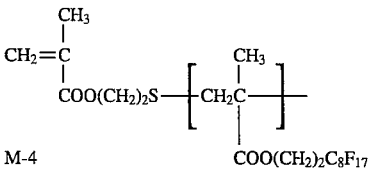 M-4 |

TABLE B-continued

| Synthesis Example of Thermoplastic Resin Grain (ARH) | Thermoplastic Resin Grain (ARH) | Macromonomer |
|---|---|---|
| 8 | ARH-8 | $CH_2=C(CH_3)-COO(CH_2)_2NHCOO(CH_2)_2S-[CH_2C(CH_3)(COO(CH_2)_3Si(CH_3)_2)(CH_2C_2F_5)]-$ M-5 |
| 9 | ARH-9 | $CH_2=C(CH_3)-COO(CH_2)_2NH-[CH_2CH_2N(CO-C_7F_{15})]-CH_3$ M-6 |

SYNTHESIS EXAMPLE 10 OF THERMOPLASTIC RESIN GRAIN (ARH): (ARH-10)

A mixture of 5 g of coarse powder of a styrene-butadiene copolymer (48/52 ratio by weight) (Sorprene 303 manufactured by Asahi Kasei Kogyo Kabushiki Kaisha) having a softening point of 45° C. pulverized by a trioblender, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLES 11 TO 16 OF THERMOPLASTIC RESIN GRAIN (ARH): (ARH-11) TO (ARH-16)

Each dispersion was prepared according to a wet type dispersion process in the same manner as in Synthesis Example 10 of Thermoplastic Resin Grain (ARH) except for using each of the compounds shown in Table C below in place of Sorprene 303 as thermoplastic resin (A). An average grain diameter of each of the white dispersion obtained was in a range of from 0.3 to 0.6 μm. A softening point of each of the resin grains was in a range of from 40° C. to 100° C.

TABLE C

| Synthesis Example of Thermoplastic Resin Grain (ARH) | Thermoplastic Resin Grain (ARH) | Thermoplastic Resin (A) |
|---|---|---|
| 11 | ARH-11 | Ethylene/methacrylic acid copolymer (96.4:3.6 by molar ratio) (Nimacrel N-699 manufactured by Du Pont-Mitsui Polychemicals Co., Ltd.) |
| 12 | ARH-12 | Ethylene/vinyl acetate copolymer (Evaflex 420 manufactured by Du Pont-Mitsui Polychemicals Co., Ltd.) |
| 13 | ARH-13 | Ethylene/ethyl acrylate copolymer (Evaflex-EEA, A-703 manufactured by Du Pont-Mitsui Polychemicals Co., Ltd.) |
| 14 | ARH-14 | Ethylene/vinyl acetate copolymer (Flvax, manufactured by E. J. du pont de Nemous and Co.) |
| 15 | ARH-15 | Cellulose acetate butyrate (Cellidor Bsp. manufactured by Bayer AG) |
| 16 | ARH-16 | Polyvinyl butyral resin (S-Lec manufactured by Sekisui Chemical Co., Ltd.) |

SYNTHESIS EXAMPLE 1 OF THERMOPLASTIC RESIN GRAIN (ARL): (ARL-1)

A mixed solution of 12 g of Dispersion Stabilizing Resin (Q-1) described above, 70 g of vinyl acetate, 30 g of vinyl butyrate and 388 g of Isopar H was heated to a temperature of 80° C. under nitrogen gas stream while stirring. To the solution was added 1.5 g of AIBN as a polymerization initiator, followed by reacting for 2 hours. Then, 0.8 g of AIBN was added to the reaction mixture, the reaction was carried out for 2 hours and 0.8 g of AIBN was further added thereto, followed by reacting for 2 hours. After cooling, the reaction mixture was passed through a nylon cloth of 200 mesh to obtain a white dispersion which was a latex of good monodispersity having a polymerization ratio of 93% and an average grain diameter of 0.18 μm. An Mw of the resin grain was $8\times10^4$ and a Tg thereof was 18° C.

SYNTHESIS EXAMPLE 2 OF THERMOPLASTIC RESIN GRAIN (ARL): (ARL-2)

A mixed solution of 18 g of Dispersion Stabilizing Resin (Q-3) described above and 549 g of Isopar H was heated to a temperature of 55° C. under nitrogen gas stream with stirring. To the mixture was added dropwise a mixture of 70 g of benzyl methacrylate, 30 g of methyl acrylate, 2.6 g of methyl 3-mercaptopropionate and 1.0 g of AIVN over a period of one hour, followed by further reacting for one hour. Then 0.8 g of AIVN was added to the reaction mixture, the temperature thereof was raised to 75° C., and the reaction was conducted for 2 hours. Further, 0.8 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.18 μm. An Mw of the resin grain was $3\times10^4$ and a Tg thereof was 18° C.

SYNTHESIS EXAMPLES 3 TO 12 OF THERMOPLASTIC RESIN GRAIN (ARL): (ARL-3) TO (ARL-12)

Each of the thermoplastic resin grains (ARL) was synthesized in the same manner as in Synthesis Example 2 of Thermoplastic Resin Grain (ARL) except for using each of the monomers shown in Table D below in place of 70 g of benzyl methacrylate and 30 g of methyl acrylate. A polymerization ratio of each of the white dispersions obtained was in a range of from 90 to 99% and an average grain diameter thereof was in a range of from 0.13 to 0.20 μm with good monodispersity. A Tg of each of the resin grains was in a range of from 10° C. to 25° C.

TABLE D

| Synthesis Example of Thermoplastic Resin Grain (ARL) | Thermoplastic Resin Grain (ARL) | Monomer | |
|---|---|---|---|
| 3 | ARL-3 | Phenetyl methacrylate | 70 g |
| | | methyl acrylate | 30 g |
| 4 | ARL-4 | 3-Phenylpropyl methacrylate | 80 g |
| | | Ethyl acrylate | 20 g |
| 5 | ARL-5 | Methyl methacrylate | 60 g |
| | | 2-Methoxyethyl methacrylate | 40 g |
| 6 | ARL-6 | Vinyl toluene | 20 g |
| | | 2-Ethylhexyl methacrylate | 15 g |
| | | Methyl methacrylate | 65 g |
| 7 | ARL-7 | Vinyl acetate | 70 g |
| | | Vinyl valerate | 30 g |
| 8 | ARL-8 | Methyl methacrylate | 60 g |
| | | Butyl methacrylate | 20 g |
| | | 2,3-Dipropoxypropyl methacrylate | 20 g |
| 9 | ARL-9 | Vinyl acetate | 90 g |
| | | Vinyl laurate | 10 g |
| 10 | ARL-10 | Vinyl acetate | 75 g |
| | | Vinyl propionate | 25 g |
| 11 | ARL-11 | Vinyl acetate | 90 g |
| | | Methyl crotonate | 10 g |
| 12 | ARL-12 | 2-Phenyl-2-methylethyl methacrylate | 75 g |
| | | Methyl acrylate | 25 g |

SYNTHESIS EXAMPLE 1 OF RESIN GRAIN (AR): (AR-1)

A mixed solution of 12 g of Dispersion Stabilizing Resin (Q-1) described above, 70 g of vinyl acetate, 30 g of vinyl butyrate and 388 g of Isopar H was heated to a temperature of 80° C. under nitrogen gas stream while stirring. To the solution was added 1.5 g of AIBN as a polymerization initiator, followed by reacting for 2 hours. Then, 0.8 g of AIBN was added to the reaction mixture, the reaction was carried out for 2 hours and 0.8 g of AIBN was further added thereto, followed by reacting for 2 hours. After cooling, the reaction mixture was passed through a nylon cloth of 200 mesh to obtain a white dispersion which was a latex of good monodispersity having a polymerization ratio of 93% and an average grain diameter of 0.18 μm. An Mw of the resin grain was $8\times10^4$ and a Tg thereof was 18° C.

A mixture of the whole amount of the resin dispersion (as seed) and 10 g of Dispersion Stabilizing Resin (Q-5) having the structure shown below was heated to a temperature of 60° C. under nitrogen gas stream with stirring. To the mixture was added dropwise a mixture of 10 g of a dimethylsiloxane macromonomer FM-0725 (manufactured by Chisso Corp.; Mw: $1\times10^4$), 50 g of methyl methacrylate, 40 g of methyl acrylate, 2.0 g of methyl 3-mercaptopropionate, 0.8 g of AIVN and 400 g Isopar H over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.25 μm. The resin grain thus-obtained had a core/shell structure comprising the resin of a relatively low glass transition point forming a core portion and the resin of a relatively high glass transition point forming a shell portion.

Dispersion Stabilizing Resin (Q-5)

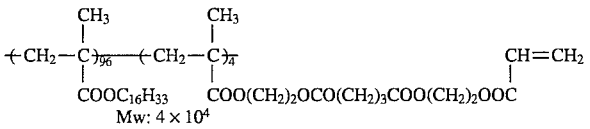

Mw: $4 \times 10^4$

Synthesis Examples of Resin (P):

SYNTHESIS EXAMPLE 1 OF RESIN (P): (P-1)

A mixed solution of 80 g of methyl methacrylate, 20 g of a dimethylsiloxane macromonomer (FM-0725 manufactured by Chisso Corp.; Mw: $1\times10^4$), and 200 g of toluene was heated to a temperature of 75° C. under nitrogen gas stream. To the solution was added 1.0 g of 2,2'-azobisisobutyronitrile (abbreviated as AIBN), followed by reacting for 4 hours. To the mixture was further added 0.7 g of AIBN, and the reaction was continued for 4 hours. An Mw of the copolymer thus-obtained was $5.8\times10^4$ (as measured by a GPC method).

Resin (P-1)

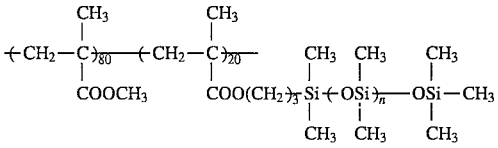

SYNTHESIS EXAMPLES 2 TO 9 OF RESIN (P): (P-2) TO (P-9)

Each of copolymers was synthesized in the same manner as in Synthesis Example 1 of Resin (P), except for replacing methyl methacrylate and the macromonomer (FM-0725) with each monomer corresponding to the polymer component shown in Table E below. An Mw of each of the resulting polymers was in a range of from $4.5\times10^4$ to $6\times10^4$.

TABLE E

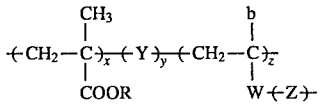

| Synthesis Example of Resin (P) | Resin (P) | −R | −Y− | −b | −W− | −Z− | x/y/z (weight ratio) |
|---|---|---|---|---|---|---|---|
| 2 | P-2 | $-C_2H_5$ | $-CH_2-C(CH_3)(COOCH_2\underset{O}{CHCH_2})-$ | $-CH_3$ | $-COO(CH_2)_2S-$ | $-CH_2-C(CH_3)(COO(CH_2)_2C_8F_{17})-$ | 65/15/20 |
| 3 | P-3 | $-CH_3$ | $-CH_2-CH(COOCH_3)-$ | $-H$ | $COO(CH_2)_2OCO-*$ <br> $*-(CH_2)_2-S-$ | $-CH_2-C(CH_3)(COOCH_2CF_2CFHCF_3)-$ | 60/10/30 |
| 4 | P-4 | $-CH_3$ | $-CH_2-C(CH_3)(COOCH_2CH(OH)CH_2OH)-$ | $-CH_3$ | $COOCH_2CH(OH)CH_2-*$ <br> $*-OOC(CH_2)_2S-$ | $-CH_2-C(CH_3)(COO(CH_2)_3Si(CH_3)_2-OSi(CH_3)_2-CH_3)-$ | 65/10/25 |
| 5 | P-5 | $-C_3H_7$ | $-CH_2-C(CH_3)(COO(CH_2)_2NHCOOCH(CF_3)_2)-$ | $-CH_3$ | $COOCH_2CH(OH)CH_2-*$ <br> $*-OOC(CH_2)_2S-$ | $-CH_2-C(CH_3)(COO(CH_2)_2Si(CH_3)_2-(OSi(CH_3)_2)_3-OSi(CH_3)_2-CH_3)-$ | 65/15/20 |
| 6 | P-6 | $-CH_3$ | $-CH_2-C(CH_3)(COO(CH_2)_3Si(OC_2H_5)_3)-$ | $-CH_3$ | $COOCH_2CH(OH)CH_2-*$ <br> $*-OOC(CH_2)_2S-$ | $-CH_2-C(CH_3)(COO(CH_2)_3Si(OSi(CH_3)_3)_2-O-Si(CH_3)_3)-$ | 50/20/30 |

TABLE E-continued
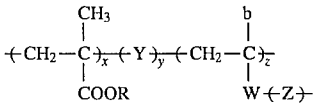
| Synthesis Example of Resin (P) | Resin (P) | −R | −Y− | −b | −W− | −Z− | x/y/z (weight ratio) |
|---|---|---|---|---|---|---|---|
| 7 | P-7 | $-C_2H_5$ | 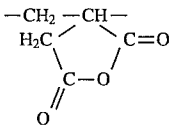 | −H | $-CONH(CH_2)_2S-$ | 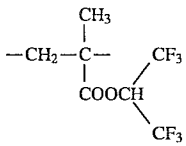 | 57/8/35 |
| 8 | P-8 | $-CH_3$ | $-CH_2-CH(CONH(CH_2)_6OH)-$ | −H | $COO(CH_2)_2OCO-*$ <br> $*-CH_2S-$ | $-CH_2-CH(CONHC_{17}F_{35})-$ | 70/15/15 |
| 9 | P-9 | $-C_2H_5$ | $-CH_2-C(CH_3)(COO(CH_2)_2NHCO-CH(COCH_3)-COCH_3)-$ | $-CH_3$ | $COO(CH_2)_2OCO-*$ <br> $*-CH_2S-$ | $-CH_2-C(CH_3)(COO(CH_2)_3SO_2NHC_{12}F_{25})-$ | 80/0/20 |

SYNTHESIS EXAMPLE 10 OF RESIN (P): (P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

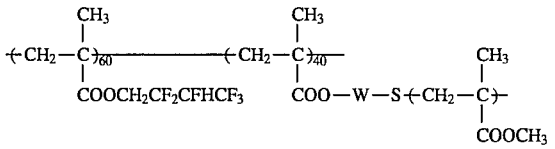

—W—: an organic residue (unknown)

SYNTHESIS EXAMPLES 11 TO 15 OF RESIN (P): (P-11) TO (P-15)

Each of copolymers was synthesized in the same manner as in Synthesis Example 10 of Resin (P), except for replacing the monomer and the macromonomer used in Synthesis Example 10 of Resin (P) with each monomer and each macromonomer both corresponding to the polymer components shown in Table F below. An Mw of each of the resulting copolymers was in a range of from $4.5\times10^4$ to $6.5\times10^4$.

TABLE F

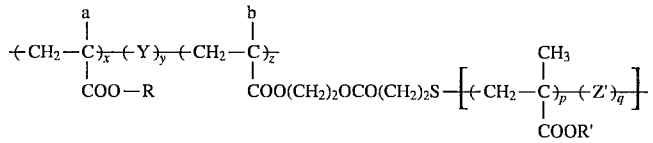

| Synthesis Example of Resin (P) | Resin (P) | −a | −R | −Y− | −b | −R' | −Z'− | x/y/z | p/q |
|---|---|---|---|---|---|---|---|---|---|
| 11 | P-11 | $-CH_3$ | $-(CH_2)_2C_nF_{2n+1}$ n = 8~10 | — | $-CH_3$ | $-CH_3$ | $-CH_2-C(CH_3)(COOCH_2CH(O)CH_2)-$ | 70/0/30 | 70/30 |
| 12 | P-12 | $-CH_3$ | $-(CH_2)_2CF_2CFHCF_3$ | — | $-H$ | $-CH_3$ | $-CH_2-C(CH_3)(COO(CH_2)_3Si(OCH_3)_2)-$ | 60/0/40 | 70/30 |
| 13 | P-13 | $-CH_3$ | $-CH_2CF_2CF_2H$ | $-CH_2-C(CH_3)(COO(CH_2)_2Si(CH_3)(OSi(CH_3)_2OSi(CH_3)_3)(CH_3))-$ | $-CH_3$ | — | $-CH_2-C(CH_3)(COOCH_2CH=CH_2)-$ | 40/30/30 | 90/10 |
| 14 | P-14 | $-H$ | $-CH_2CF_2CFHCF_3$ | $-CH_2-C(CH_3)(COO(CH_2)_3Si(CF_3)_2-C_2H_5)-$ | $-CH_3$ | $-C_2H_5$ | $-CH_2-C(CH_3)(COO(CH_2)_2OH)-$ | 30/45/25 | 60/40 |
| 15 | P-15 | $-CH_3$ | $-(CH_2)_3Si(CH_3)(OSi(CH_3)_2OSi(CH_3)_3)-CH_3$ | — | $-CH_3$ | $-C_2H_5$ | $-CH_2-CH(COOH)-$ | 80/0/20 | 90/10 |

SYNTHESIS EXAMPLE 16 OF RESIN (P): (P-16)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Polymer Initiator (PI-1)

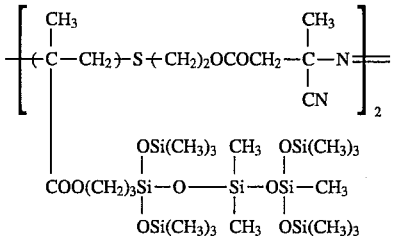

Polymer (P-16)

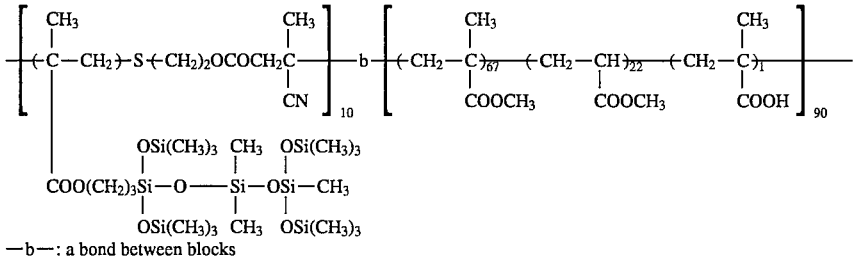

—b—: a bond between blocks

SYNTHESIS EXAMPLE 17 OF RESIN (P): (P-17)

A mixed solution of 70 g of methyl methacrylate and 200 g of tetrahydrofuran was thoroughly degassed under nitrogen gas stream and cooled to −20° C. To the solution was added 0.8 g of 1,1-diphenylbutyl lithium, followed by reacting for 12 hours. To the reaction mixture was then added a mixed solution of 30 g of Monomer (M-1) shown below and 60 g of tetrahydrofuran which had been thoroughly degassed under nitrogen gas stream, followed by reacting for 8 hours.

After rendering the mixture to 0° C., 10 ml of methanol was added thereto to conduct a reaction for 30 minutes to stop the polymerization. The resulting polymer solution was heated to a temperature of 30° C. with stirring, and 3 ml of a 30% ethanol solution of hydrogen chloride was added thereto, followed by stirring for 1 hour. The reaction mixture was distilled under reduced pressure to remove the solvent until the volume was reduced to half and the residue was reprecipitated in 1 l of petroleum ether. The precipitate was collected and dried under reduced pressure to obtain 76 g of a polymer having an Mw of $6.8\times10^4$.

Monomer (M-1)

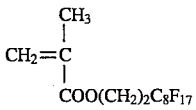

Resin (P-17)

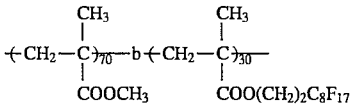

SYNTHESIS EXAMPLE 18 OF RESIN (P): (P-18)

A mixed solution of 52.5 g of methyl methacrylate, 22.5 g of methyl acrylate, 0.5 g of methylaluminum tetraphenylporphynate, and 200 g of methylene chloride was heated to a temperature of 30° C. under nitrogen gas stream. The solution was irradiated with light from a xenon lamp of 300 W at a distance of 25 cm through a glass filter for 20 hours. To the mixture was added 25 g of Monomer (M-2) shown below, and the resulting mixture was further irradiated with light under the same conditions as above for 12 hours. To the reaction mixture was added 3 g of methanol, followed by stirring for 30 minutes to stop the reaction. The reaction mixture was reprecipitated in 1.5 l of methanol, and the precipitate was collected and dried to obtain 78 g of a polymer having an Mw of $9\times10^4$.

Monomer (M-2)

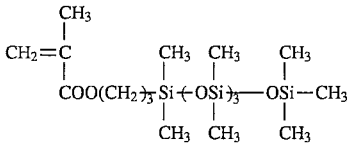

Resin (P-18)

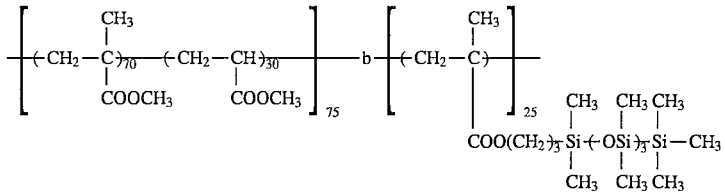

SYNTHESIS EXAMPLE 19 OF RESIN (P): (P-19)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (M-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (M-3)

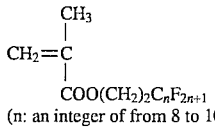

(n: an integer of from 8 to 10)

Resin (P-19)

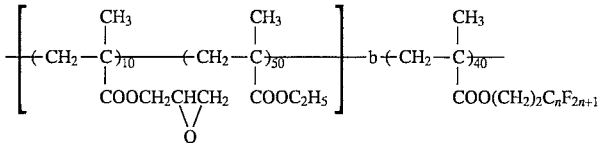

(n: an integer of from 8 to 10)

SYNTHESIS EXAMPLE 20 OF RESIN (p): (P-20)

A mixture of 50 g of methyl methacrylate, 25 g of ethyl methacrylate, and 1.0 g of benzyl isopropylxanthate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. To the mixture was added 25 g of Monomer (M-1) described above. After displacing the atmosphere with nitrogen, the mixture was again irradiated with light for 10 hours. The reaction mixture obtained was reprecipitated in 2 l of methanol, and the precipitate was collected and dried to obtain 63 g of a polymer having an Mw of $6\times10^4$.

Resin (P-20)
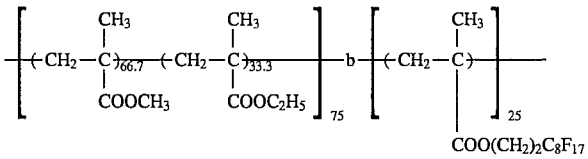
SYNTHESIS EXAMPLES 21 TO 27 OF RESIN (P): (P-21) TO (P-27)
Each of copolymers shown in Table G below was prepared in the same manner as in Synthesis Example 19 of Resin (P). An Mw of each of the resulting polymers was in a range of from $3.5\times10^4$ to $6\times10^4$.
TABLE G
| Synthesis Example of Resin (P) | Resin (P) | A–B Type Block Copolymer (weight (ratio) |
|---|---|---|
| 21 | P-21 | 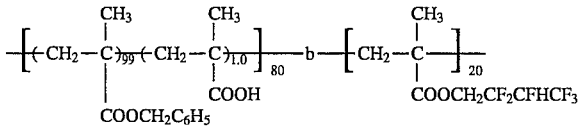 |
| 22 | P-22 | 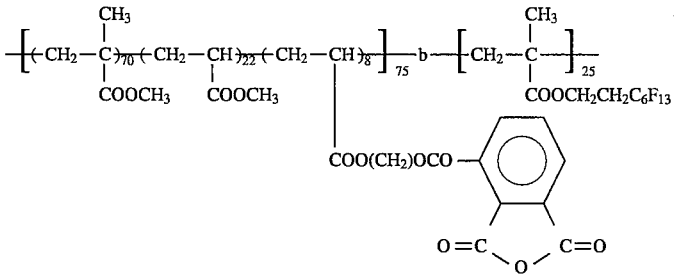 |
| 23 | P-23 | 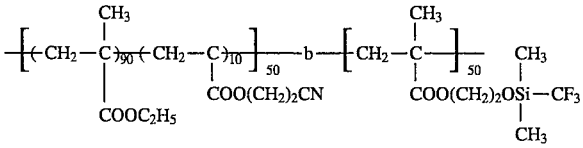 |
| 24 | P-24 | 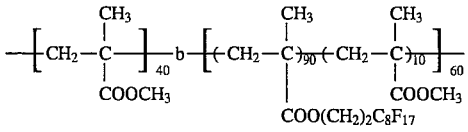 |
| 25 | P-25 | 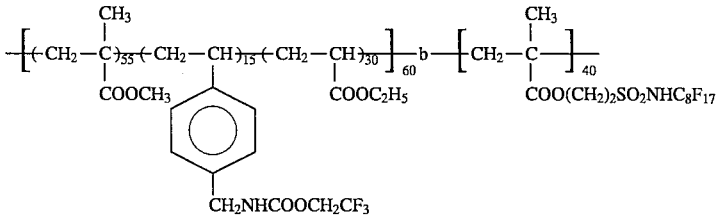 |
| 26 | P-26 | 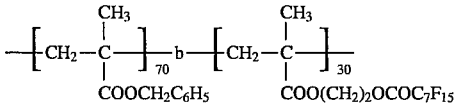 |

TABLE G-continued

| Synthesis Example of Resin (P) | Resin (P) | A–B Type Block Copolymer (weight (ratio) |
|---|---|---|
| 27 | P-27 | 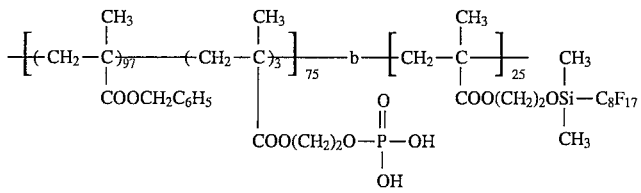 |

SYNTHESIS EXAMPLE 28 OF RESIN (P): (P-28)

A copolymer having an Mw of $4.5\times10^4$ was prepared in the same manner as in Synthesis Example 19 of Resin (P), except for replacing benzyl N,N-diethyldithiocarbamate with 18 g of Initiator (I-11) having the structure shown below.

Initiator (I-11)

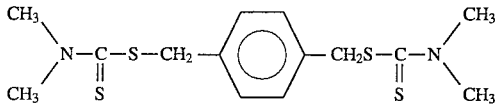

Resin (P-28)

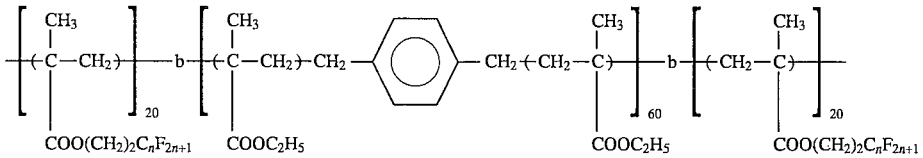

(n: an integer of from 8 to 10)

under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (M-2) described above, and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

SYNTHESIS EXAMPLE 29 OF RESIN (P): (P-29)

A copolymer having an Mw of $2.5\times10^4$ was prepared in the same manner as in Synthesis Example 20 of Resin (P), except for replacing benzyl isopropylxanthate with 0.8 g of Initiator (I-12) having the structure shown below.

Initiator (I-12)

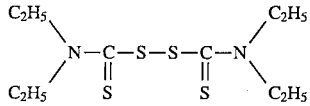

Resin (P-29)

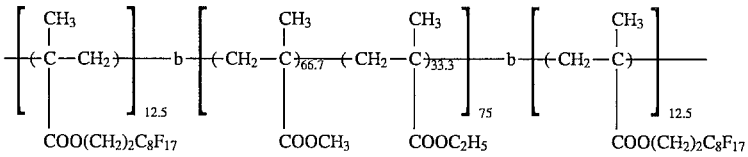

SYNTHESIS EXAMPLE 30 OF RESIN (P): (P-30)

A mixed solution of 68 g of methyl methacrylate, 22 g of methyl acrylate, 10 g of glycidyl methacrylate, 17.5 g of Initiator (I-13) having the structure shown below, and 150 g of tetrahydrofuran was heated to a temperature of 50° C.

Initiator (I-13)
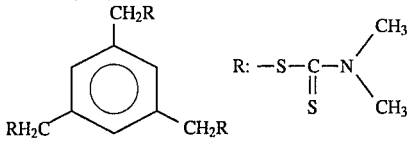
Resin (P-30)
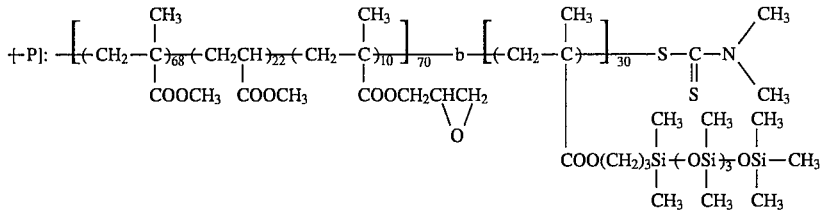
SYNTHESIS EXAMPLES 31 TO 38 OF RESIN (P): (P-31) TO (P-38)
In the same manner as in Synthesis Example 30 of Resin (P), except for replacing 17.5 g of Initiator (I-13) with 0.031 mol of each of the initiators shown in Table H below, each of the copolymers shown in Table H was obtained. A yield thereof was in a range of from 70 to 80 g and an Mw thereof was in a range of from $4\times10^4$ to $6\times10^4$.

TABLE H
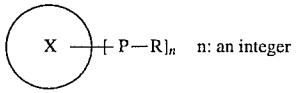
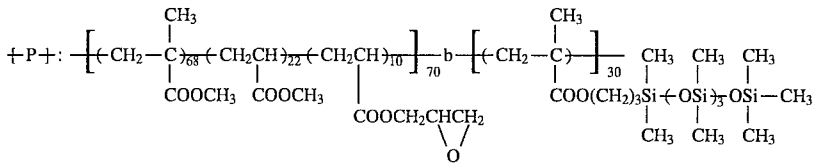
| Synthesis Example of Resin (P) | Resin (P) | Initiator (I) | —R | 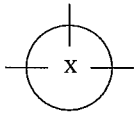 |
|---|---|---|---|---|
| 31 | P-31 | 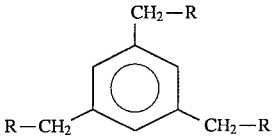 (I-14) | 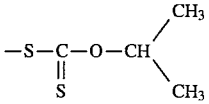 | 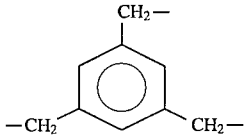 |
| 32 | P-32 | 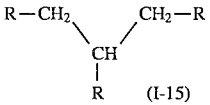 (I-15) | 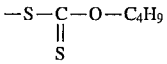 | 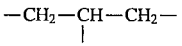 |
| 33 | P-33 | 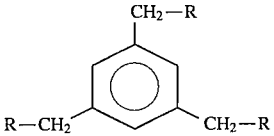 (I-16) | 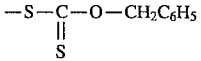 | 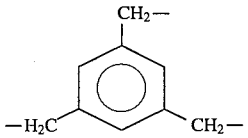 |
| 34 | P-34 | 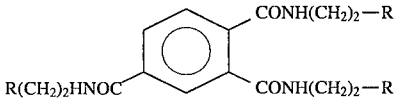 (I-17) | 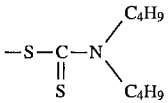 | 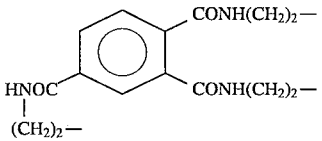 |

TABLE H-continued
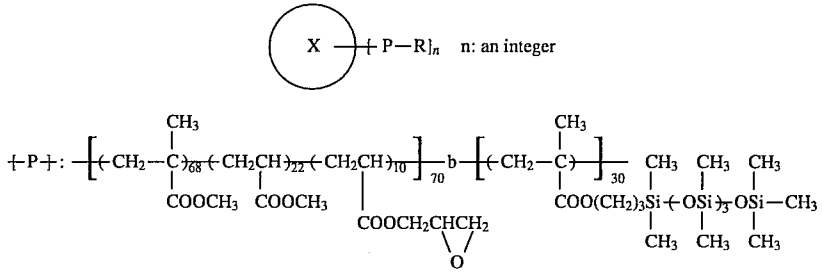
| Synthesis Example of Resin (P) | Resin (P) | Initiator (I) | —R | X |
|---|---|---|---|---|
| 35 | P-35 | 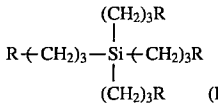 (I-18) | 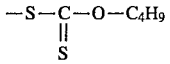 | 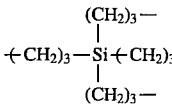 |
| 36 | P-36 | 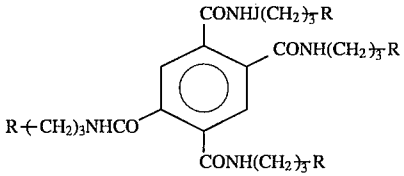 (I-19) | 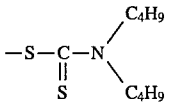 | 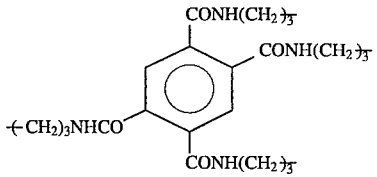 |
| 37 | P-37 | 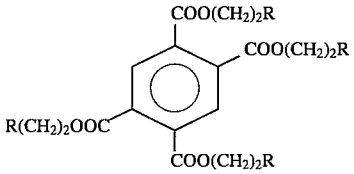 (I-20) | 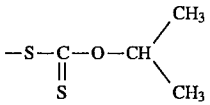 | 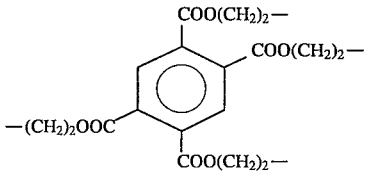 |

TABLE H-continued
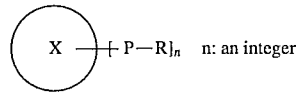
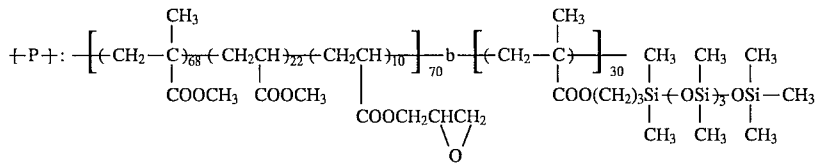
| Synthesis Example of Resin (P) | Resin (P) | Initiator (I) | —R | X |
|---|---|---|---|---|
| 38 | P-38 | 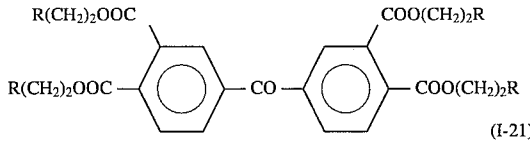 (I-21) | 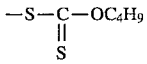 | 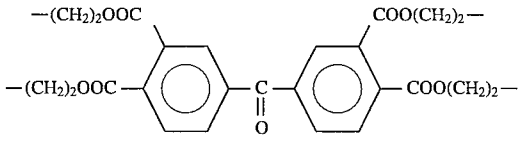 |

Synthesis Examples of Resin Grain (L):

SYNTHESIS EXAMPLE 1 OF RESIN GRAIN (L): (L-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of 2,2'-azobis(isovaleronitrile) (abbreviated as AIVN), followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm (the grain diameter was measured by CAPA-500 manufactured by Horiba, Ltd.).

Monomer (LM-1)

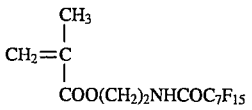

Dispersion Stabilizing Resin (LP-1)

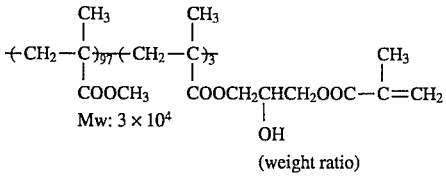

SYNTHESIS EXAMPLE 2 OF RESIN GRAIN (L): (L-2)

A mixed solution of 5 g of AB-6 (a monofunctional macromonomer comprising a butyl acrylate unit, manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

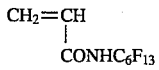

SYNTHESIS EXAMPLES 3 TO 11 OF RESIN GRAIN (L): (L-3) TO (L-11)

Each of resin grains was synthesized in the same manner as in Synthesis Example 1 of Resin Grain (L), except for replacing Monomer (LM-1), ethylene glycol dimethacrylate and methyl ethyl ketone with each of the compounds shown in Table I below, respectively. An average grain diameter of each of the resulting resin grains was in a range of from 0.15 to 0.30 μm.

TABLE I

| Synthesis Example of Resin Grain (L) | Resin Grain (L) | Monomer (LM) | Crosslinking Polyfunctional Monomer | Amount | Reaction Solvent |
|---|---|---|---|---|---|
| 3 | L-3 | (LM-3) 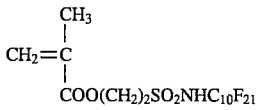 | Ethylene glycol dimethacrylate | 2.5 g | Methyl ethyl ketone |
| 4 | L-4 | (LM-4) 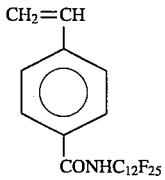 | Divinylnenzene | 3 g | Methyl ethyl ketone |
| 5 | L-5 | (LM-5) $CH_2{=}CH$ \| $CONHC_{12}F_{25}$ | — | | Methyl ethyl ketone |

TABLE I-continued

| Synthesis Example of Resin Grain (L) | Resin Grain (L) | Monomer (LM) | Crosslinking Poly-functional Monomer | Amount | Reaction Solvent |
|---|---|---|---|---|---|
| 6 | L-6 | (LM-6) $CH_2=C(CH_3)-CONH(CH_2)_3Si(CH_3)_2-C_4F_9$ | Diethylene glycol diacrylate | 5 g | n-Hexane |
| 7 | L-7 | (LM-7) $CH_2=C(CH_3)-COOCH(CF_3)_2$ | Ethylene glycol dimethacrylate | 3.5 g | n-Hexane |
| 8 | L-8 | (LM-8) $CH_2=CH-COO(CH_2)_2CONHC_8F_{17}$ | Trimethylolpropane trimethacrylate | 3.5 g | Methyl ethyl ketone |
| 9 | L-9 | (LM-9) $CH_2=CH-CONH(CH_2)_3Si[OSi(CH_3)_3]_3$ | Trivinylbenzene | 3.3 g | Ethyl acetate/ n-Hexane (4/1 by weight) |
| 10 | L-10 | (LM-10) $CH_2=CH-COO(CH_2)_2NHCONH(CH_2)_3Si[OSi(CH_3)_3]_3$ | Divinyl glutaconate | 4 g | Ethyl acetate/ n-Hexane (2/1 by weight) |
| 11 | L-11 | (LM-11) $CH_2=C(CH_3)-CONHCOOCH_2CF_2CFHCF_3$ | Propylene glycol diacrylate | 3 g | Methyl ethyl ketone |

SYNTHESIS EXAMPLES 12 TO 17 OF RESIN GRAIN (L): (L-12) TO (L-17)

Each of resin grains was synthesized in the same manner as in Synthesis Example 2 of Resin Grain (L), except for replacing 5 g of AB-6 (dispersion stabilizing resin) with each of Resins (LP) shown in Table J below. An average grain diameter of each of the resulting resin grains was in a range of from 0.10 to 0.25 μm.

TABLE J

| Synthesis Example of Resin Grain (L) | Grain (L) | Dispersion Stabilizing Resin (LP) | A-mount |
|---|---|---|---|
| 12 | L-12 | $\leftarrow CH_2-C(CH_3)(COOCH_3)\rightarrow_{67}\leftarrow CH_2-CH(COOCH_3)\rightarrow_{30}\leftarrow CH_2-C(CH_3)(COO(CH_2)_2OCO(CH_2)_2COOCH_2CH(OH)CH_2OCO-CH=CH_2)\rightarrow_{3}$ (LP-2) Mw $3.3\times10^4$ | 4 g |

TABLE J-continued

| Synthesis Example of Resin Grain (L) | Grain (L) | Dispersion Stabilizing Resin (LP) | A-mount |
|---|---|---|---|
| 13 | L-13 | 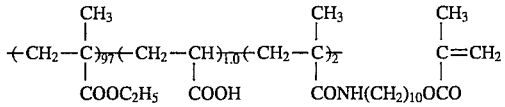 (LP-3) Mw $2.5 \times 10^4$ | 2 g |
| 14 | L-14 | 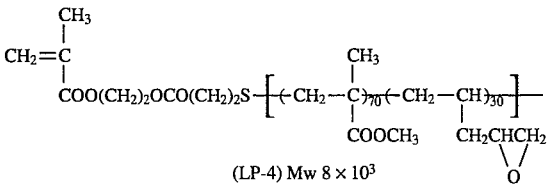 (LP-4) Mw $8 \times 10^3$ | 6 g |
| 15 | L-15 | 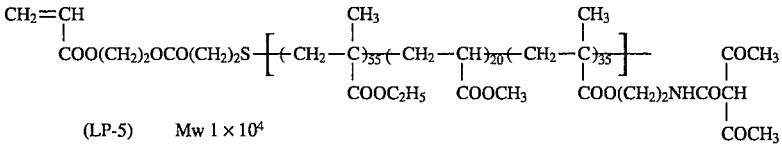 (LP-5) Mw $1 \times 10^4$ | 6 g |
| 16 | L-16 | 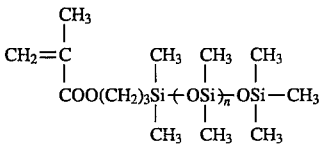 (LP-6) Mw $1 \times 10^4$ | 4 g |
| 17 | L-17 | 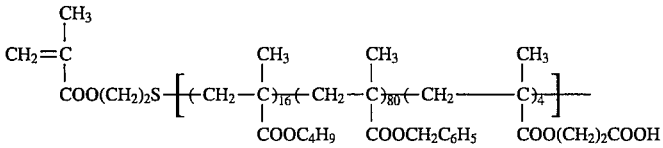 (LP-7) Mw $6 \times 10^3$ | 5 g |

SYNTHESIS EXAMPLES 18 TO 23 OF RESIN GRAIN (L): (L-18) TO (L-23)

Each of resin grains was synthesized in the same manner as in Synthesis Example 2 of Resin Grain (L), except for replacing 40 g of Monomer (LM-2) with each of the monomers shown in Table K below and replacing 5 g of AB-6 (dispersion stabilizing resin) with 6 g of Dispersion Stabilizing Resin (LP-8) having the structure shown below. An average grain diameter of each of the resulting resin grains was in a range of from 0.05 to 0.20 μm.

Dispersion Stabilizing Resin (LP-8)

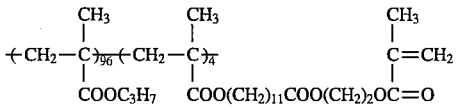

Mw $3 \times 10^4$

TABLE K

| Synthesis Example of Resin Grain (L) | Grain Grain (L) | Monomer (LM) | Amount | Other Monomer | Amount |
|---|---|---|---|---|---|
| 18 | L-18 | (LM-12) $CH_2{=}C(CH_3)COO(CH_2)_2C_8F_{17}$ | 30 g | $CH_2{=}CH(CONHCH_2OCH_3)$ | 10 g |
| 19 | L-19 | (LM-13) $CH_2{=}C(CH_3)COO(CH_2)_3Si(CH_3)_2(OSi(CH_3)_2)_2OSi(CH_3)_3$ | 25 g | Glycidyl methacrylate | 15 g |
| 20 | L-20 | (LM-14) $CH_2{=}CH(COOCH_2CF_2CF_2H)$ | 20 g | Acrylonitrile | 20 g |
| 21 | L-21 | (LM-15) 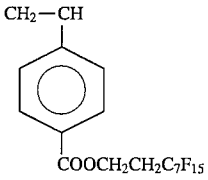 | 25 g | $CH_2{=}CH$ 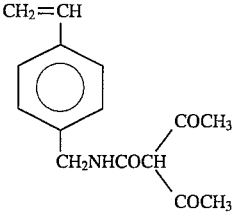 | 15 g |
| 22 | L-22 | (LM-16) $CH_2{=}C(CH_3)COO(CH_2)_2OSi(CH_3)_2-C_6F_{13}$ | 20 g | Methyl methacrylate | 20 g |
| 23 | L-23 | (LM-17) $CH_3CH{=}CH(COOCH_2CF_2CFHCF_3)$ | 20 g | Vinyl acetate | 20 g |

EXAMPLE 1

A mixture of 2 g of X-form metal-free phthalocyanine (manufactured by Dainippon Ink and Chemicals, Inc.), 10 g of Binder Resin (B-1) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion was added 0.2 g of Resin (P-1), followed by further dispersing for 2 minutes. The glass beads were separated by filtration to prepare a dispersion for a light-sensitive layer.

Binder Resin (B-1)

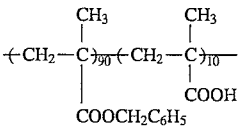

Mw $3\times10^4$

Compound (A)

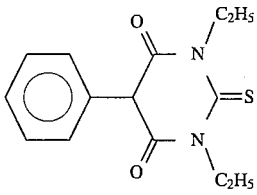

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 20 seconds to form a light-sensitive layer having a thickness of 8 μm. The adhesion strength of the surface of the resulting electrophotographic light-sensitive element measured according to JIS Z 0237-1980 "Testing methods of pressure sensitive adhesive tapes and sheets" was 5 gram.force (gf).

For comparison, an electrophotographic light-sensitive element was prepared in the same manner as described above except for eliminating 0.2 g of Resin (P-1) according to the present invention. The adhesive strength of the surface thereof was more than 450 gf and did not exhibit releasability.

The light-sensitive element was installed in an apparatus as shown in FIG. 6. On the surface of light-sensitive element installed on a drum which was rotated at a circumferential speed of 10 mm/sec, a dispersion of positively charged resin grains shown below was supplied using a slit electrodeposition device, while putting the light-sensitive element to earth and applying an electric voltage of −180 V to an electrode of the slit electrodeposition device, whereby the resin grains were electrodeposited. The dispersion medium was removed by air-squeezing, and the resin grains were fused by an infrared line heater to form a film, whereby a transfer layer composed of a thermoplastic resin was prepared on the light-sensitive element. A thickness of the transfer layer was 4 μm.

| Dispersion of Positively Charged Resin Grains | |
|---|---|
| Thermoplastic Resin Grain (ARH-3) | 4.2 g (solid basis) |
| Thermoplastic Resin Grain (ARL-1) | 1.8 g (solid basis) |
| Charge Control Agent (CD-1) (octadecyl vinyl ether/N-dodecyl maleic monoamide copolymer (1:1 by molar ratio)) | 0.02 g |
| Branched tetradecyl alcohol (FOC-1400 manufactured by Nissan Chemical Industries, Ltd.) | 10 g |
| Isopar H (manufactured by Esso Standard Oil Co.) | 1 liter |

COMPARATIVE EXAMPLE 1

An electrophotographic light-sensitive element having a transfer layer provided thereon was prepared in the same manner as in Example 1 except for using 6 g of Thermoplastic Resin Grain (ARH-3) alone for the formation of transfer layer in place of 4.2 g of Thermoplastic Resin Grain (ARH-3) and 1.8 g of Thermoplastic Resin Grain (ARL-1).

COMPARATIVE EXAMPLE 2

An electrophotographic light-sensitive element having a transfer layer provided thereon was prepared in the same manner as in Example 1 except for using 6 g of Thermoplastic Resin Grain (ARL-1) alone for the formation of transfer layer in place of 4.2 g of Thermoplastic Resin Grain (ARH-3) and 1.8 g of Thermoplastic Resin Grain (ARL-1).

The formation of toner images on the resulting light-sensitive material was conducted in the following manner.

The light-sensitive material was charged to +450 V with a corona discharge in dark and exposed to light of a gallium-aluminum-arsenic semiconductor laser (output: 5 mW; oscillation wavelength: 780 nm) at an irradiation dose on the surface of the light-sensitive material of 30 erg/cm$^2$, a pitch of 25 μm, and a scanning speed of 300 cm/sec. The scanning exposure was in a negative mirror image mode based on digital image data on an information for yellow color separation among digital image data on informations for yellow, magenta, cyan and black color separations which had been obtained by reading an original by a color scanner, conducting several corrections relating to color reproduction peculiar to color separation system and memorized in a hard disc.

Thereafter, the exposed light-sensitive material was subjected to reversal development using a liquid developer prepared by diluting a yellow liquid developer for Signature System (manufactured by Eastman Kodak Co.) with 75-fold by weight Isopar H (manufactured by Esso Standard Oil Co.) in a developing machine having a pair of flat development electrodes while a bias voltage of +400 V was applied to the electrode on the side of the light-sensitive material to thereby electrodeposit toner particles on the exposed areas. The light-sensitive material was then rinsed in a bath of Isopar H alone to remove any stains in the non-image areas.

The above procedure was repeated using each information for magenta, cyan and black in place of the information for yellow.

The light-sensitive material was then subjected to fixing by means of a heat roller whereby the toner images thus-formed were fixed. The images were visually evaluated for fog and image quality in order to confirm reproducibility of the duplicated images before transfer.

The light-sensitive material having yellow, magenta, cyan and black toner images was brought into contact with coated paper as a receiving material and they were passed between a pair of rubber rollers which were in contact with each other under a pressure of 8 kgf/cm$^2$ and whose surface temperature was constantly maintained at 80° C. at a transportation speed of 12 mm/sec.

After cooling the sheets while being in contact with each other to room temperature, the coated paper was stripped from the light-sensitive element. The color images transferred on coated paper were visually evaluated for fog and image quality.

Moreover, the coated paper was held in a commercially available file made of vinyl chloride sheets, loaded with a weight of 1 kg and stored under condition of 30° C. and 80% RH for one week to visually evaluate the occurrence of transfer of the transfer layer and toner images onto the vinyl chloride sheet.

The results thus obtained are shown in Table L below.

TABLE L

| | Example 1 | Comparative Example 1 | Comparative Example 2 |
|---|---|---|---|
| Image Forming Performance (image formed on the light-sensitive material) | good | good | good |
| Image Reproducibility (image transferred on coated paper) | good | heavy unevenness of transfer, many cuttings of images | heavy unevenness of transfer, many cuttings of images |
| Aptitude for | no image | no image | severe image |

TABLE L-continued

| | Example 1 | Comparative Example 1 | Comparative Example 2 |
|---|---|---|---|
| Filing | transfer onto the sheet | transfer onto the sheet | transfer onto the sheet |

As can be seen from the results shown in Table L above, the duplicated images formed on the transfer layer provided on the electrophotographic light-sensitive element were clear and had good quality without the formation of fog in the non-image areas with both Example 1 according to the present invention and Comparative Examples 1 and 2. These results means that the resin (P) used in the photoconductive layer and the transfer layer containing the thermoplastic resin provided on the photoconductive layer do not adversely affect on the electrophotographic characteristics in practical use.

As a result of the evaluation on image reproducibility of the toner images transferred together with the transfer layer from the light-sensitive material to coated paper as a receiving material, the toner images were entirely transferred together with the transfer layer to coated paper and the residue of transfer layer was not observed at all on the light-sensitive element with Example 1 according to the present invention. Further, as a result of visual evaluation of toner images transferred on coated paper using an optical microscope of 200 magnifications, it was found that reproducibility of the duplicated image was good and cutting and spreading were not observed in highly accurate image portions such as fine lines, fine letters and dots.

On the contrary, severely uneven transfer of the transfer layer occurred and the color images on coated paper could not be practically used in case of Comparative Examples 1 and 2. It is believed that the occurrence of uneven transfer in case of Comparative Example 1 results mainly from insufficient releasability between the transfer layer and the light-sensitive element because the transfer layer is not rendered sufficiently thermoplastic under the transfer condition described above. Further, it is believed that the occurrence of uneven transfer in case of Comparative Example 2 is caused by indiscriminate break of the transfer layer per se since cohesive force of the thermoplastic resin used in the transfer layer becomes small as compared with adhesion between the transfer layer and coated paper due to low temperature for rendering the transfer layer thermoplastic.

The transfer layer according to the present invention was excellent in releasability on the surface of the light-sensitive element and adhesion to the receiving material and was free from the break upon destruction of cohesion.

Moreover, the transferred color images on coated paper according to the present invention were stable and did not peel in case of filing in polymer sheets. Also, retouch and seal was conducted on the transferred color image same as on conventional paper. These features are important in practical use.

As described above, the full-color duplicate obtained according to the color image forming method of the present invention has excellent image reproducibility and preservability.

EXAMPLE 2

An amorphous silicon electrophotographic light-sensitive element was installed in an apparatus as shown in FIG. 6. The adhesive strength of the surface thereof was 170 gf.

On the surface of light-sensitive element installed on a drum, whose surface temperature was adjusted to 60° C. and which was rotated at a circumferential speed of 10 mm/sec, a first dispersion of positively charged resin grains prepared by adding 6 g (solid basis) of Thermoplastic Resin Grain (ARH-4), 0.03 g of Charge Control Agent (CD-1) described above and 10 g of silicone oil (KF-96 manufactured by Shin-Etsu Silicone Co., Ltd.) to one liter of Isopar G was supplied using a slit electrodeposition device, while putting the light-sensitive element to earth and applying an electric voltage of −200 V to an electrode of the slit electrodeposition device, whereby the resin grains were electrodeposited. The resin grains were fixed to form a first transfer layer.

On the surface of first transfer layer, a second dispersion of positively charged resin grains prepared by adding 6 g of Thermoplastic Resin Grain (ARL-7) and 0.03 g of Charge Control Agent (CD-1) described above to one liter of Isopar G was supplied in the same manner as above to prepare a second transfer layer. Thus, an electrophotographic material having the first transfer layer having a thickness of 2 μm and the second transfer layer having a thickness of 2 μm provided on the amorphous silicon light-sensitive element was prepared.

COMPARATIVE EXAMPLE 3

An electrophotographic light-sensitive element having a transfer layer provided thereon was prepared in the same manner as in Example 2 except for using only the first dispersion of positively charged resin grains and changing the electric voltage applied to −150 V. The resulting transfer layer had a thickness of 4 μm.

COMPARATIVE EXAMPLE 4

An electrophotographic light-sensitive element having a transfer layer provided thereon was prepared in the same manner as in Example 2 except for using only the second dispersion of positively charged resin grains and changing the electric voltage applied to −150 V. The resulting transfer layer had a thickness of 4 μm.

The formation of toner images on the resulting light-sensitive material was conducted in the following manner.

The light-sensitive material was charged to +700 V with a corona discharge and exposed to light using a semiconductor laser (oscillation wavelength: 780 nm) at an irradiation dose of 25 erg/cm$^2$ on the surface of the light-sensitive material in a positive mirror image mode based on an information for yellow color separation of digital image data same as those described in Example 1. The residual potential of the exposed areas was +120 V. Then, the exposed light-sensitive material was subjected to reversal development using a liquid developer prepared by diluting a yellow toner for an electrostatic color plotter (Versateck 3000 manufactured by Xerox Corp.) with 50-fold Isopar H (manufactured by Esso Standard Oil Co.) in a developing machine having a pair of flat development electrodes while a bias voltage of +300 V was applied to the electrode on the side of the light-sensitive material to thereby electrodeposit toner particles on the exposed areas. The light-sensitive material was then rinsed in a bath of Isopar H alone to remove any stain in the non-image areas.

The above procedure was repeated using each information for magenta, cyan and black in place of the information for yellow.

The light-sensitive material having yellow, magenta, cyan and black toner images was brought into contact with coated paper as a receiving material and they were passed between a pair of rubber rollers which were in contact with each other under a pressure of 10 kgf/cm$^2$ and whose surface temperature was constantly maintained at 70° C. at a transportation speed of 8 mm/sec.

After cooling the sheets while being in contact with each other to room temperature, the coated paper was stripped from the light-sensitive element to obtain color duplicated paper.

The image forming performance, image reproducibility and aptitude for filing were evaluated in the same manner as in Example 1. Excellent results on these characteristics were obtained in Example 2 according to the present invention. On the contrary, cuttings of color images were observed on coated paper due to uneven transfer in case of Comparative Examples 3 and 4. Further, with respect to the aptitude for filing, the color image peeled and adhered to the sheet in case of Comparative Example 4. These results indicate superiority of the present invention.

Further, the transfer of toner images to coated paper was conducted using the electrophotographic light-sensitive material of Example 2 in the same manner as described above except for using a transfer pressure of 4.5 kgf/cm$^2$ and a transportation speed of 50 mm/sec. The color duplicate obtained exhibited the excellent characteristics same as in Example 2. These results demonstrate that the reduced pressure and increased speed for transfer can be achieved by constructing the transfer layer of specified double-layered structure according to the present invention.

EXAMPLE 3

A mixture of 2 g of X-form metal-free phthalocyanine (manufactured by Dainippon Ink and Chemicals, Inc.), 10 g of Binder Resin (B-2) having the structure shown below, 0.18 g of Compound (B) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 0.3 g of Resin (P-2), 0.03 g of phthalic anhydride, and 0.001 g of o-chlorophenol, followed by further dispersing for 2 minutes. The glass beads were separated by filtration to prepare a dispersion for a light-sensitive layer.

Binder Resin (B-2)

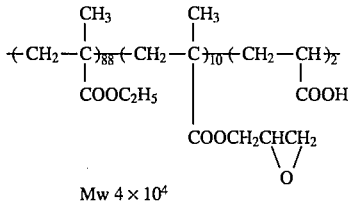

Mw $4\times10^4$

Compound (B)

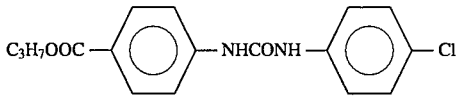

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 30 minutes to form a light-sensitive layer having a thickness of 8 μm. The adhesion strength of the surface of the resulting electrophotographic light-sensitive element was 5 gf.

For comparison, an electrophotographic light-sensitive element was prepared in the same manner as described above except for eliminating 0.3 g of Resin (P-2) according to the present invention. The adhesive strength of the surface thereof was more than 450 gf and did not exhibit releasability.

The light-sensitive element was installed in an apparatus as shown in FIG. 3. A mixture of thermoplastic resins comprising ethylene/vinyl acetate copolymer (vinyl acetate content: 20% by weight; Tg: 40° C.) and vinyl acetate/vinyl butyrate copolymer (ratio by weight: 70/30; Tg: 18° C.) in a ratio of 6:4 by weight was coated on the surface of light-sensitive layer at a rate of 20 mm/sec by a hot melt coater adjusted at 120° C. and cooled by blowing cool air from a suction/exhaust unit, followed by maintaining the surface temperature of light-sensitive element at 30° C. to prepare a transfer layer having a thickness of 3 μm.

The resulting light-sensitive material was charged to +700 V with a corona discharge in dark and exposed to light using a semiconductor laser (oscillation wavelength: 780 nm) based on digital image data on an information for yellow color separation among digital image data on informations for yellow, magenta, cyan and black color separations which had been obtained by reading an original by a color scanner, conducting several corrections relating to color reproduction peculiar to color separation system and memorized in a hard disc. The residual potential of the exposed areas was +220 V and that of the unexposed areas was +600 V. The exposed light-sensitive material was pre-bathed with Isopar H (manufactured by Esso Standard Oil Co.) by a pre-bathing device equipped in a developing unit and then subjected to reversal development supplying a liquid developer prepared by diluting a yellow toner for an electrostatic color plotter (Versateck 3000 manufactured by Xerox Corp.) with 50-fold Isopar H from the developing unit while a bias voltage of +500 V was applied to the electrode on the developing unit side to thereby electrodeposit yellow toner particles on the non-exposed areas. The light-sensitive material was rinsed in a bath of Isopar H alone to remove any stain in the non-image areas, followed by drying under a suction/exhaust unit.

The above procedure was repeated using each information for magenta, cyan and black in place of the information for yellow.

The light-sensitive material having yellow, magenta, cyan and black toner images was passed under an infrared line heater lighted to raise the surface temperature thereof to about 80° C. measured by a radiation thermometer, and then brought into contact with coated paper as a receiving material and they were passed between a pair of rubber heating rollers which were in contact with each other under a pressure of 10 kgf/cm$^2$ and whose surface temperature was constantly maintained at 120° C. at a transportation speed of 15 mm/sec.

After cooling the sheets while being in contact with each other by passing under a cooling roller, the coated paper was stripped from the light-sensitive element, thereby the toner images on the light-sensitive element being wholly heat-transferred onto the coated paper together with the transfer layer. Since the toner images were entirely covered with the thermoplastic resin of the transfer layer on the coated paper, the images were prevented from falling off when they were rubbed.

EXAMPLE 4

An amorphous silicon electrophotographic light-sensitive element was treated with a silane coupling agent of tridecyl hexyl trimethoxysilane to modify the surface of amorphous silicon, thereby releasability thereof being increased. Specifically, the adhesive strength of the surface decreased from 180 gf to 50 gf.

The resulting light-sensitive element was installed in an apparatus as shown in FIG. 4, and a transfer layer was formed on the surface thereof by a transfer method from release paper using an apparatus as shown in FIG. 5. Specifically, a mixture of vinyl acetate/vinyl propionate copolymer (ratio by weight: 75/25; Tg: 22° C.) as the resin (AL) and methyl methacrylate/methyl acrylate copolymer (ratio by weight: 60/40; Tg: 40° C.) as the resin (AH) in a ratio of 5:5 by weight was applied on release paper (Separate Shi manufactured by Oji Paper Co., Ltd.) to form a transfer layer having a thickness of 3 μm. The transfer layer on release paper was transferred on the surface of the above-described light-sensitive element by being brought into contact with each other under the application of pressure. The resulting light-sensitive material was subjected to the formation of color images and transfer of the color images onto coated paper together with the transfer layer in the same procedure as in Example 2 to form color images on coated paper.

The color images obtained on coated paper were good without the occurrence of background stain and the images had sufficiently high strength, similar to those in Example 2.

EXAMPLES 5 TO 16

The same procedure as in Example 1 was conducted except for using 2 g of each of the resins (P) and/or resin grains (L) for a light-sensitive layer and 4 g of each of the thermoplastic resin grains (ARH) and 4 g of each of the thermoplastic resin grains (ARL) for a transfer layer each shown in Table M below in place of 0.2 g of Resin (P-1) used in the light-sensitive layer and 4.2 g of Thermoplastic Resin Grain (ARH-3) and 1.8 g of Thermoplastic Resin Grain (ARL-1) used in the transfer layer to form color images.

TABLE M

| Example | Resin (P) and/or Resin Grain (L) | | Thermoplastic Resin Grain (ARH)/(ARL) |
|---|---|---|---|
| 5 | P-2 | | ARH-1/ARL-1 |
| 6 | P-11 | | ARH-2/ARL-2 |
| 7 | L-14 | | ARH-3/ARL-3 |
| 8 | L-19 | | ARH-4/ARL-4 |
| 9 | L-7 | | ARH-7/ARL-5 |
| 10 | P-31 | 1 g | ARH-8/ARL-6 |
| | L-1 | 1 g | |
| 11 | P-36 | 1 g | ARH-9/ARL-7 |
| | L-6 | 1 g | |
| 12 | P-35 | 1 g | ARH-10/ARL-8 |
| | L-10 | 1 g | |
| 13 | P-22 | | ARH-11/ARL-10 |
| 14 | P-21 | 1 g | ARH-12/ARL-11 |
| | L-19 | 1 g | |
| 15 | P-24 | | ARH-14/ARL-12 |
| 16 | L-14 | | ARH-16/ARL-9 |

The color images formed on coated paper were good and no residual transfer layer was observed on the surface of light-sensitive element after the transfer process in each Example. These results indicate that the transferability of transfer layer is improved by using a combination of the resin (AL) having a relatively low transition point and the resin (AH) having a relatively high transition point.

EXAMPLES 17 TO 26

The same procedure as in Example 2 was conducted except for using a dispersion containing 6 g of each of the thermoplastic resin grains shown in Table N below in place of 6 g of Thermoplastic Resin Grain (ARH-4) of the first transfer layer and 6 g of thermoplastic Resin Grain (ARL-7) of the second transfer layer respectively and changing a thickness of the transfer layer to 5 μm in total wherein a thickness ratio of first layer/second layer was controlled as shown in Table N below to form color images on coated paper.

TABLE N

| Example | Thermoplastic Resin Grain (AR) First layer/Second layer | Thickness Ratio |
|---|---|---|
| 17 | ARH-2/ARL-1 | 5/5 |
| 18 | ARH-3/ARL-2 | 5/5 |
| 19 | ARH-1/ARL-3 | 6/4 |
| 20 | ARH-6/ARL-4 | 7/3 |
| 21 | ARH-8/ARL-5 | 4/6 |
| 22 | ARH-11/ARL-7 | 5/5 |
| 23 | ARH-12/ARL-8 | 8/2 |
| 24 | ARH-13/ARL-11 | 5/5 |
| 25 | ARH-15/ARL-10 | 4/6 |
| 26 | ARH-4/ARL-12 | 4/6 |

The color duplicates obtained had good duplicated images similar to those in Example 2. The image preservability of these duplicates was also very good.

EXAMPLES 27 TO 32

A mixed solution of 1.0 g of Resin (P-12), 15 g of Binder Resin (B-3) having the structure shown below, 0.03 g of phthalic anhydride and 100 g of toluene was coated on the surface of an amorphous silicon electrophotographic light-sensitive element at a thickness of 1.5 μm and set to touch, and the resulting surface layer was cured at 130° C. for one hour. The adhesive strength of the surface of the resulting light-sensitive element was 3 gf.

Binder Resin (B-3)

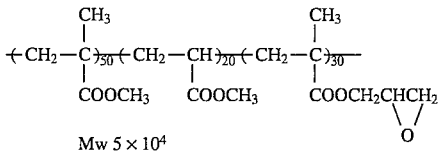

Mw $5\times10^4$

The same procedure as in Example 3 was conducted except for using the resulting light-sensitive element and each of the thermoplastic resins (AH) and thermoplastic resins (AL) shown in Table O below in place of the X-form metal-free phthalocyanine light-sensitive element and the thermoplastic resins (AH) and (AL) used for forming the transfer layer to prepare each electrophotographic light-sensitive material. A Tg of each of the thermoplastic resins (AH) was in a range of from 40° C. to 90° C. and a Tg of each of the thermoplastic resins (AL) was in a range of from −20° C. to 25° C. in Table N below. Formation of color images on the electrophotographic light-sensitive material and transfer of the color images onto coated paper were conducted in the same manner as in Example 2. The color duplicates thus-obtained exhibited excellent characteristics similar to those in Example 2.

Formation of Transfer Layer

Paper having a transfer layer composed of each of the thermoplastic resins (AH) and (AL) shown in Table P below having a thickness of 4 μm provided on release paper (Sun Release manufactured by Sanyo Kokusaku Pulp Co., Ltd.) was installed on an apparatus as shown in FIG. 5, and the transfer layer on release paper was transferred onto the surface of the light-sensitive element under conditions of a pressure between rollers of 3 kgf/cm$^2$, a surface temperature of 80° C. and a transportation speed of 10 mm/sec.

TABLE O

| Example | Thermoplastic Resin (AH) | Thermoplastic Resin (AL) | (AH)/(AL) (weight ratio) |
|---|---|---|---|
| 27 | 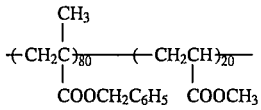 (AH-1) Mw $2\times10^4$ | 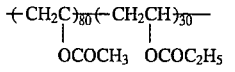 (AL-1) Mw $1.5\times10^5$ | 50/50 |
| 28 | 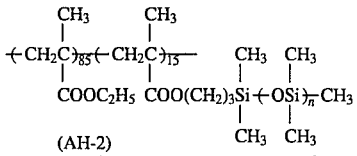 (AH-2) Mw $4\times10^4$ (Mw of graft portion $5\times10^3$) | Polyvinylidene chloride (Krehalon manufactured by Kureha Chemical Industry Co., Ltd.) | 60/40 |
| 29 | 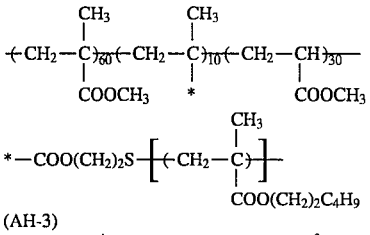 (AH-3) Mw $3.5\times10^4$ (Mw of graft portion $6\times10^3$) | 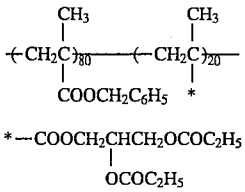 (AL-2) Mw $1\times10^4$ | 50/50 |
| 30 | 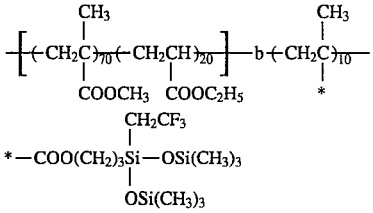 (AH-4) Mw $2\times10^4$ | 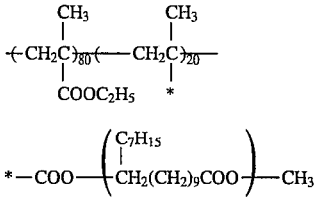 (AL-3) Mw $3\times10^4$ (Mw of graft portion $4\times10^3$) | 40/60 |
| 31 | 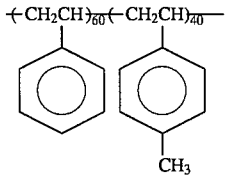 (AH-5) Mw $1.5\times10^4$ | Styrene/butadiene copolymer (48/52 by weight) (Sorprene 303 manufasctured by Asahi Kasei Kogyo Kabushiki Kaisha) | 75/25 |
| 32 | Cellulose acetate butyrate (Cellidor Bsp (manufactured by Bayer AG)) | 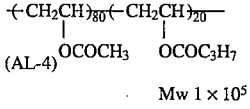 (AL-4) Mw $1\times10^5$ | 50/50 |

EXAMPLES 33 TO 42

Color images were formed on coated paper in the same manner as described in Example 4 except for changing the method for formation of transfer layer as follows:

TABLE P

| Example | Thermoplastic Resin (AH) | Thermoplastic resin (AL) | (AH)/(AL) (weight ratio) |
|---|---|---|---|
| 33 | $-(CH_2C(CH_3)(COO(CH_2)_2C_6H_5))_{95}-(CH_2CH(CN))_5-$ (AH-6) Mw $4 \times 10^4$ | $-(CH_2CH(OCOCH_3))_{90}-(CH_2CH(OCOC_{11}H_{23}))_{10}-$ (AL-5) Mw $9 \times 10^4$ | 50/50 |
| 34 | Polyvinyl butyral resin (S-Lec manufactured by Sekisui Chemical Co., Ltd.) | $-(CH_2C(CH_3)(COOC_3H_7))_{80}-(CH_2CH(OCOCH_3))_{20}-$ (AL-6) Mw $9 \times 10^3$ | 30/70 |
| 35 | $-(CH_2C(CH_3)(COOCH_3))_{75}-(CH_2C(CH_3)(COOCH_2CH_2OC_4H_9))_{25}-$ (AH-7) Mw $8 \times 10^3$ | Ethylene/ethyl acrylate copolymer (70/30 by weight) (AL-7) Mw $5 \times 10^4$ | 60/40 |
| 36 | (AH-2) | (AL-4) | 30/70 |
| 37 | $-(CH_2C(CH_3)(COOCH_3))_{70}-(CH_2CH(C_6H_4CH_3))_{30}-$ (AH-8) Mw $1.5 \times 10^4$ | Natural rubber | 80/20 |
| 38 | $-(OOC(CH_2)_3CO)_{50}-[OOC(CH_2)_3C(CH_3)_2]_{50}-$ (AH-9) Mw $8 \times 10^3$ | $HO-[CH(C_7H_{15})(CH_2)_9COO]-CH_3$ (AL-8) Mw $6 \times 10^3$ | 80/20 |

TABLE P-continued
| Example | Thermoplastic Resin (AH) | Thermoplastic resin (AL) | (AH)/(AL) (weight ratio) |
|---|---|---|---|
| 39 | 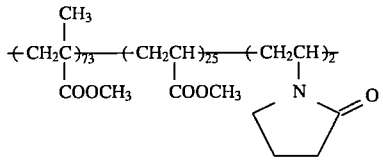 <br>(AH-10) Mw $3\times10^4$ | 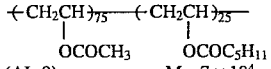 <br>(AL-9) Mw $7\times10^4$ | 70/30 |
| 40 | 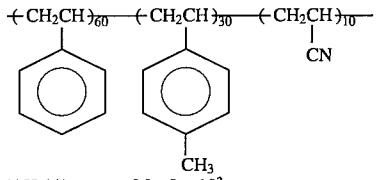 <br>(AH-11) Mw $9\times10^3$ | 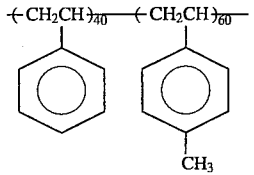 <br>(AL-10) Mw $8\times10^3$ | 50/50 |
| 41 | 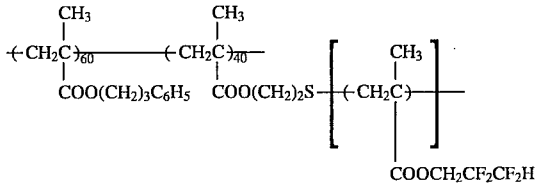 <br>(AH-12)<br>Mw $9\times10^3$ (Mw of graft portion $3\times10^3$) | 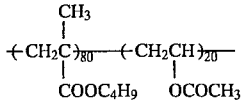 <br>(AL-11) Mw $8.5\times10^3$ | 25/75 |
| 42 | 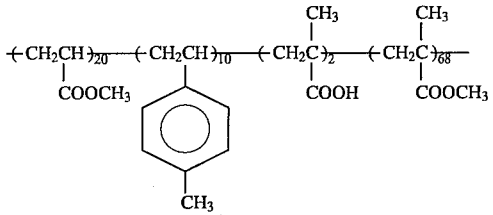 <br>(AH-13) Mw $3\times10^4$ | 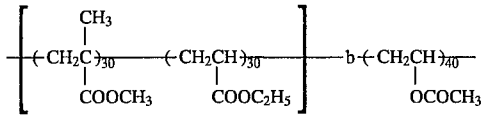 <br>—b—: bond connecting blocks<br>(AL-12) Mw $2.5\times10^4$ | 60/40 |

The color images obtained were clear without the formation of background stain and degradation of image quality was hardly recognized as compared with the original. These results indicate that in the transfer method wherein the transfer layer is formed on the light-sensitive element by a transfer method from release paper and the transfer layer having toner images provided thereon is further transferred to coated paper, the transfer of the transfer layer is uniformly and entirely performed at each step without the occurrence of disadvantageous degradation of image.

EXAMPLES 43 TO 55

Each electrophotographic light-sensitive material having provided with a transfer layer and each color duplicate were prepared in the same manner as in Example 3, except for using 10 g of each of the binder resins (B), 0.3 g of each of resins (P), each of the compounds for crosslinking shown in Table Q below in place of 10 g of Binder Resin (B-2), 0.3 g of Resin (P-2) and the compounds for crosslinking (i.e., phthalic anhydride and o-chlorophenol) used in Example 3.

As a result of the evaluation of various characteristics in the same manner as in Example 1, excellent results similar to those in Example 1 were obtained. Specifically, clear color images free from background stain were formed on coated paper, and the aptitudes for filing, retouching and sealing were also good.

TABLE Q

| Example | Resin (P) | Binder Resin (B) | Compound for Crosslinking | |
|---|---|---|---|---|
| 43 | P-25 | 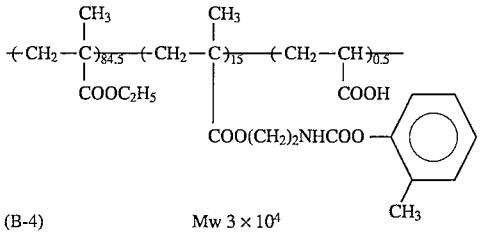 (B-4) Mw $3\times10^4$ | Pentaerythritol<br>Titanium tetrabutoxide | 0.8 g<br>0.02 g |
| 44 | P-35 | 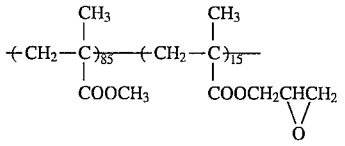 (B-5) Mw $4.5\times10^4$ | 1,2,4,5-Benzenetetra-carboxylic dianhydride<br>o-Cresol | 0.5 g<br>0.01 g |
| 45 | P-32 | 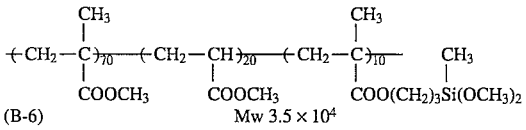 (B-6) Mw $3.5\times10^4$ | 3-Aminochloropropyl-trimethoxy silane | 0.2 g |
| 46 | P-34 | 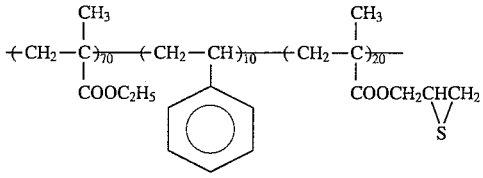 (B-7) Mw $2.5\times10^4$ | Gluconic anhydride<br>Zirconium stearate | 0.3 g<br>0.008 g |
| 47 | P-21 | 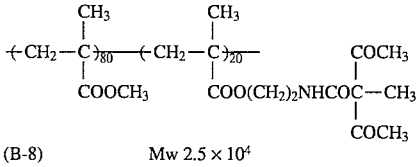 (B-8) Mw $2.5\times10^4$ | Propylene glycol<br>Titanium dibutoxy dilaurate | 1 g<br>0.002 g |
| 48 | P-8 | 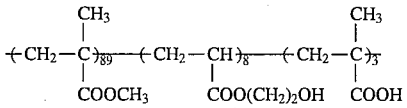 (B-9) Mw $2\times10^4$ | Phthalic anhydride<br>Zirconium acetylacetone | 0.3 g<br>0.008 g |

TABLE Q-continued

| Example | Resin (P) | Binder Resin (B) | Compound for Crosslinking | |
|---|---|---|---|---|
| 49 | P-7 | 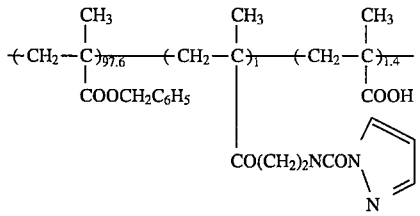 (B-10) Mw $8 \times 10^4$ | 1,6-Hexanediamine | 0.4 g |
| 50 | P-18 | 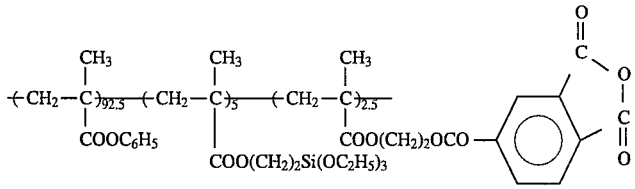 (B-11) Mw $6 \times 10^4$ | γ-Glycidopropyl trimethoxy silane | 0.1 g |
| 51 | P-23 | 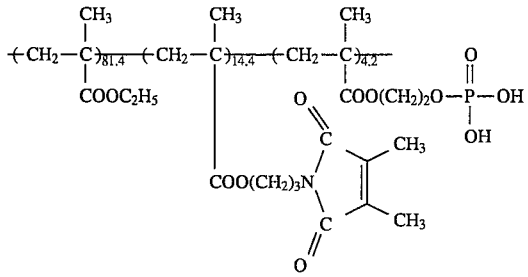 (B-12) Mw $6.3 \times 10^4$ | Benzoyl peroxide | 0.008 g |
| 52 | P-16 | 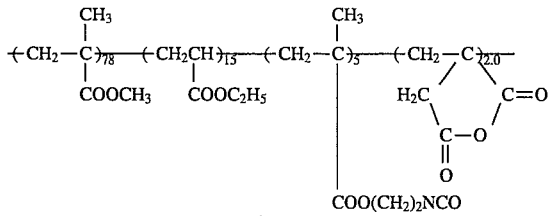 (B-13) Mw $7.5 \times 10^4$ | 1,4-Butanediol<br>Tin dibutoxy dilaurate | 0.3 g<br>0.001 g |
| 53 | P-29 | 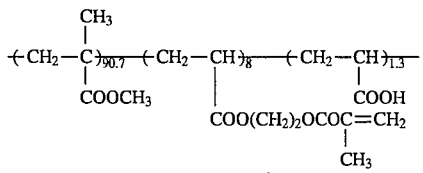 (B-14) Mw $9 \times 10^4$ | Ethylene glycol dimethacrylate<br>2,2'-Azobis(iso-valeronitrile) | 2.0 g<br>0.03 g |
| 54 | P-29 | 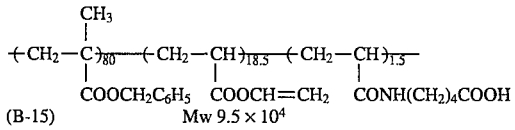 (B-15) Mw $9.5 \times 10^4$ | Divinyl adipate<br>2,2'-Azobis(iso-butyronitrile) | 2.2 g<br>0.01 g |
| 55 | P-22 | 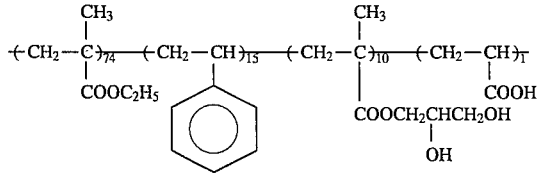 (B-16) Mw $5 \times 10^4$ | Block isocyanate (Barknock D-500 manufactured by DIK Co., Ltd.)<br>Dimer of butyl titanate | 3 g<br>0.02 g |

EXAMPLE 56

5 g of 4,4'-bis(diethylamino)-2,2'-dimethyltriphenylmethane as an organic photoconductive substance, 5 g of a polyester resin (Vylon 200 manufactured by Toyobo Co., Ltd.), 40 mg of Dye (D-1) having the structure shown below, and 0.2 g of Anilide Compound (B) having the structure shown below as a chemical sensitizer were dissolved in a mixed solvent of 30 ml of methylene chloride and 30 ml of ethylene chloride to prepare a light-sensitive solution.

Dye (D-1)

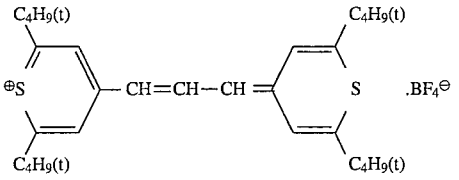

Anilide Compound (B)

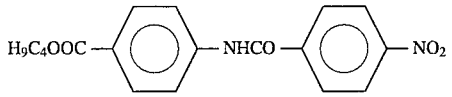

The light-sensitive solution was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm.

A solution having the composition shown below was coated on the light-sensitive element with a wire bar at a dry thickness of 2.0 μm, dried in an oven at 100° C. for 20 seconds and then heated at 120° C. for 1 hour. The coating film was allowed to stand in dark at 20° C. and 65% RH for 24 hours to prepare an electrophotographic light-sensitive element having an overcoat layer for imparting a release property. The adhesion strength of the surface of electrophotographic light-sensitive element was 0.6 gf.

| Overcoat Solution | |
|---|---|
| Methyl methacrylate/3-(trimethoxysilyl)-propyl methacrylate (70/30 by weight) copolymer (Mw: $4 \times 10^4$) | 3 g |
| Resin (P-11) | 0.15 g |
| Compound for crosslinking having the following structure: $HOOCCH_2CH_2Si(OCH_3)_3$ | 0.01 g |

-continued

| Overcoat Solution | |
|---|---|
| Dibutyltin dilaurate | 0.002 g |
| Toluene | 100 g |

On the surface of the thus-prepared light-sensitive element was formed a transfer layer having a thickness of 4 μm in the same manner as in Example 1 except for using 3 g of Thermoplastic Resin Grain (AH-2) and 3 g of Thermoplastic Resin Grain (AL-4) in place of 4.2 g of Thermoplastic Resin Grain (AH-3) and 1.8 g of Thermoplastic Resin Grain (AL-1).

The resulting light-sensitive material was charged to a surface potential of +500 V in dark and exposed imagewise using a helium-neon laser of 633 nm at an irradiation dose on the surface of the light-sensitive material of 30 erg/cm$^2$, followed by conducting the same procedure as in Example 1 to prepare a color duplicate. The color images obtained on coated paper were clear and free from background stain. The aptitudes for filing, retouching and sealing were also good.

EXAMPLE 57

A mixture of 5 g of a bisazo pigment having the structure shown below, 95 g of tetrahydrofuran and 5 g of a polyester resin (Vylon 200 manufactured by Toyoho Co., Ltd.) was thoroughly pulverized in a ball mill. The mixture was added to 520 g of tetrahydrofuran with stirring. The resulting dispersion was coated on a conductive transparent substrate used in Example 56 by a wire round rod to prepare a charge generating layer having a thickness of about 0.7 μm.

Bisazo Pigment

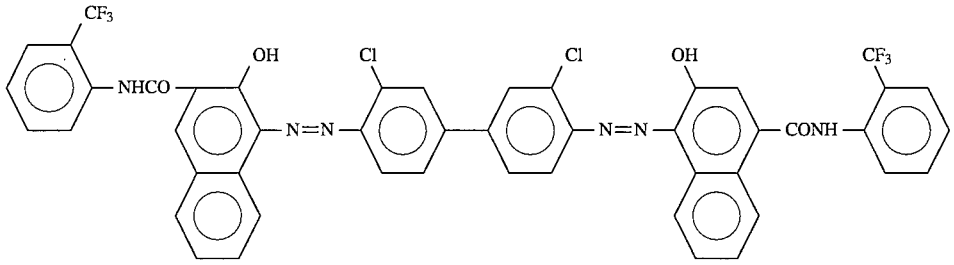

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

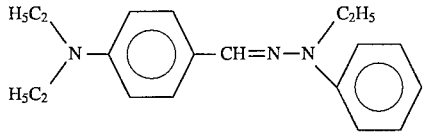

A mixed solution of 13 g of Resin (P-39) having the structure shown below, 0.2 g of phthalic anhydride, 0.002 g of o-chlorophenol and 100 g of toluene was coated on the light-sensitive layer at a dry thickness of 1 μm by a wire round rod, set to touch and heated at 120° C. for one hour to prepare a surface layer for imparting releasability. The adhesive strength of the surface of the resulting light-sensitive element was 3 gf.

Resin (P-39)

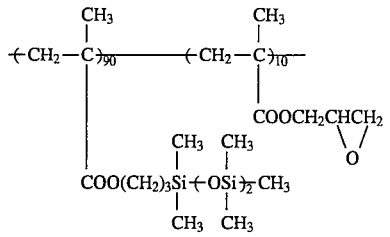

Mw $3\times10^4$

A transfer layer having a thickness of 4.5 μm was formed on the light-sensitive element in the same manner as in Example 1 except for using 4.5 g of Thermoplastic Resin Grain (ARH-9) and 2 g of Thermoplastic Resin Grain (ARL-9).

Using the resulting light-sensitive material, full-color images were formed on coated paper according to the same procedure as in Example 1. The color duplicate obtained exhibited good characteristics similar to those in Example 1.

EXAMPLE 58

A mixture of 100 g of photoconductive zinc oxide, 20 g of Binder Resin (B-17) having the structure shown below, 3 g of Resin (P-35), 0.01 g of uranine, 0.02 g of Rose Bengal, 0.01 g of bromophenol blue, 0.15 g of maleic anhydride and 150 g of toluene was dispersed by a homogenizer (manufactured by Nippon Seiki Co.) at a rotation of $9\times10^3$ r.p.m. for 10 minutes.

Binder Resin (B-17)

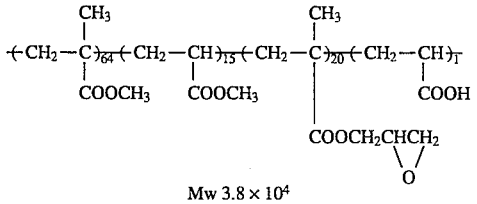

Mw $3.8\times10^4$

To the dispersion were added 0.02 g of phthalic anhydride and 0.001 g of o-chlorophenol, and the mixture was dispersed by a homogenizer at a rotation of $1\times10^3$ r.p.m. for 1 minute.

The resulting dispersion was coated on base paper for a paper master having a thickness of 0.2 mm, which had been subjected to electrically conductive treatment and solvent-resistant treatment, by a wire bar at a coverage of 25 g/m$^2$, set to touch and heated in a circulating oven at 120° C. for one hour. The adhesive strength of the surface of the electrophotographic light-sensitive element thus-obtained was 10 gf.

For comparison, an electrophotographic light-sensitive element was prepared in the same manner as described above except for eliminating 3 g of Resin (P-35). The adhesive strength of the surface thereof was 380 gf and did not exhibit releasability.

On the surface of light-sensitive element was formed a transfer layer of a double-layered structure in the following manner.

In the same manner as in Example 1 using a dispersion of positively charged resin grains prepared by adding 6 g of Thermoplastic Resin Grain (ARH-2) and 0.03 g of dizirconium naphthenate as a charge control agent to one liter of Isopar H to form a first transfer layer having a thickness of 2.5 μm. On the surface of the first transfer layer was formed a second transfer layer having a thickness of 2.5 μm using a dispersion of positively charged resin grains prepared by adding 6 g of Thermoplastic Resin Grain (ARL-10) and 0.02 g of (CD-1) described above to one liter of Isopar H.

The resulting light-sensitive material was charged to −550 V with a corona discharge in dark, exposed imagewise with flash exposure using a halogen lamp of 1.6 kW and subjected to normal development using as a liquid developer a color toner for Versateck 3000 used in Example 2 while applying a bias voltage of 100 V to a developing unit to form color images. The duplicated images formed on the transfer layer were good and clear even in highly accurate image portion such as letters, fine lines and continuous tone areas composed of dots. Also, background stain in the non-image areas was not observed.

The light-sensitive material having the toner images was brought into contact with coated paper and they were passed between a pair of hollow metal rollers covered with silicone rubber each having an infrared lamp heater integrated therein. A surface temperature of each of the rollers was 70° C., a nip pressure between the rollers was 8 kgf/cm$^2$, and a transportation speed was 12 mm/sec.

After cooling the sheets while being in contact with each other to room temperature, the coated paper was separated from the light-sensitive element whereby the toner images were entirely transferred together with the transfer layer to the coated paper. The color images obtained on coated paper were clear and free from background stain. The aptitudes for filing, retouching and sealing were also good.

EXAMPLE 59

A mixture of 100 g of photoconductive zinc oxide, 2 g of Binder Resin (B-18) having the structure shown below, 18 g of Binder Resin (B-19) having the structure shown below, 2 g of Resin (P-12), 0.02 g of Dye (D-2) having the structure shown below, 0.02 g of N-hydroxysuccinimide, and 150 g of toluene was dispersed in a homogenizer (manufactured by Nippon Seiki Co.) at a rotation of $1\times10^4$ r.p.m. for 5 minutes.

Binder Resin (B-18)

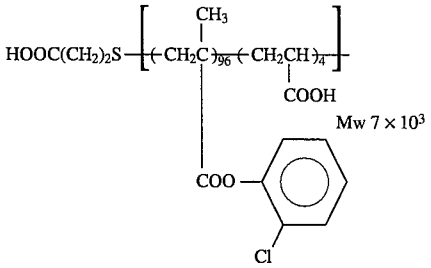

Mw $7\times10^3$

-continued

Binder Resin (B-19)

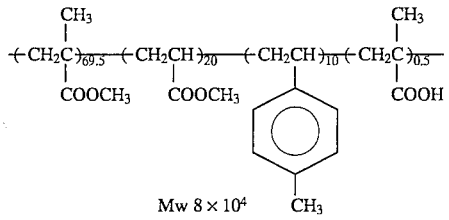

Dye (D-2)

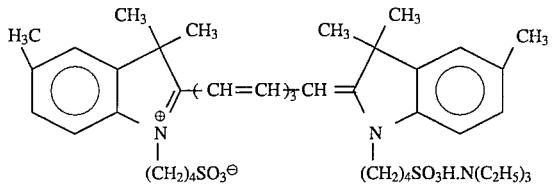

The resulting dispersion was coated on base paper for a paper master having a thickness of 0.2 mm, which had been subjected to electrically conductive treatment and solvent-resistant treatment, by a wire bar, set to touch and heated in a circulating oven at 110° C. for 15 seconds to form a light-sensitive layer having a thickness of 12 μm. As a result of the measurement of adhesion strength, the surface of the resulting light-sensitive element exhibited the adhesion strength of 5 gf which was about 1/100 of that of a light-sensitive element prepared in the same manner as above except for eliminating Resin (P-12). From these results it is believed that Resin (P-12) which is a block copolymer containing the silicon atom and/or fluorine atom-containing polymer segment is localized near the surface of light-sensitive element.

On the surface of light-sensitive element was prepared a transfer layer of double-layered structure in the same manner as described in Example 58 except for using 6 g of Thermoplastic Resin Grain (ARH-5) and 6 g of Thermoplastic Resin Grain (ARL-8) in place of 6 g of Thermoplastic Resin Grain (ARH-2) and 6 g of Thermoplastic Resin Grain (ARL-10) respectively.

The light-sensitive material was charged with a corona discharge of −6 kV in dark and exposed to light of a gallium-aluminum-arsenic semiconductor laser (output: 5 mW; oscillation wavelength: 780 nm) at an irradiation dose on the surface of the light-sensitive material of 30 erg/cm$^2$, a pitch of 25 μm, and a scanning speed of 500 cm/sec. The scanning exposure was in a positive mirror image mode based on the digital image data of an original read by a color scanner and memorized in a hard disc. The development and subsequent procedures was conducted in the same manner as in Example 1 to form color images on coated paper.

The color duplicate thus-obtained had clear images free from background stain. Specifically, toner images formed on the light-sensitive material exhibited good image reproducibility and no fog in the unexposed areas with respect to the image forming performance. Further, the transfer of the toner images onto coated paper together with the transfer layer was completely conducted without the occurrence of uneven transfer.

These results indicate that the reproduction of highly accurate images can be performed by a scanning exposure system using a semiconductor laser beam of low power same as in a case wherein a flash exposure system using visible light of high power as described in Example 58 is employed. This results from the use of the low molecular weight copolymer comprising the specified methacrylate component and the specified polar group-containing component as one of the binder resins in the photoconductive layer. By the selection of appropriate technique for increasing the electrophotographic characteristics (particularly, dark charge retention rate and photosensitivity), color duplicate of high quality are obtained in the method of forming electrophotographic color transfer image according to the present invention.

EXAMPLES 60 TO 64

Full-color duplicates were prepared in the same manner as in Example 59 except for using the compounds shown in Table R below in place of 2 g of Binder Resin (B-18), 0.02 g of Dye (D-2) and 2 g of Resin (P-12), respectively. The color duplicates obtained exhibited the excellent characteristics same as those in Example 59.

TABLE R
| Example | Resin (B) (weight ratio) | Dye (D) | Resin (P) |
|---|---|---|---|
| 60 | 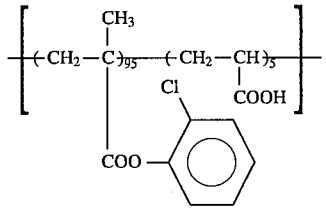 (B-20) Mw $6 \times 10^3$ | 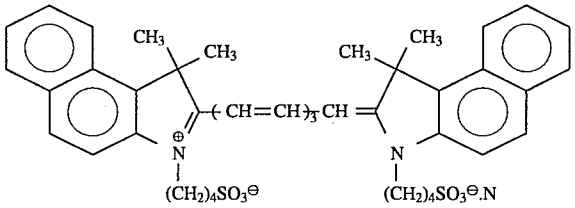 (D-3) | (P-6) |
| 61 | 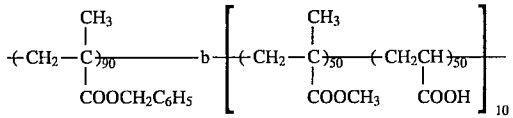 —b—: bond connecting blocks (B-21) Mw $8 \times 10^3$ | 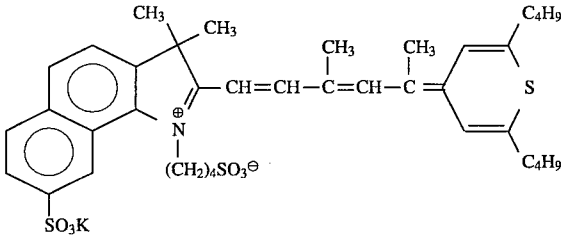 (D-4) | (P-22) |
| 62 | 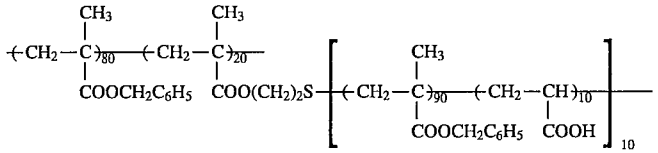 (B-22) Mw $8.5 \times 10^3$ | 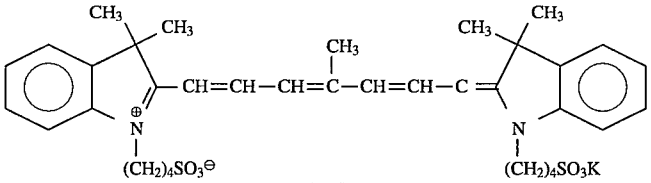 (D-5) | (P-35) |
| 63 | 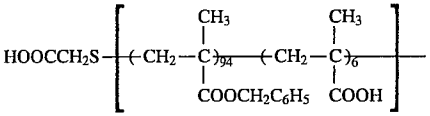 (B-23) Mw $7 \times 10^3$ | 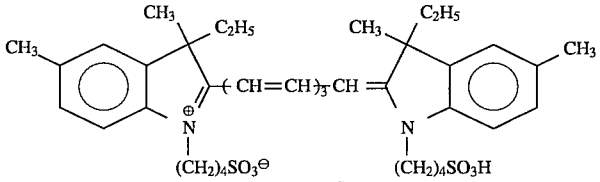 (D-6) | (P-38) |

TABLE R-continued
| Example | Resin (B) (weight ratio) | Dye (D) | Resin (P) |
|---|---|---|---|
| 64 | 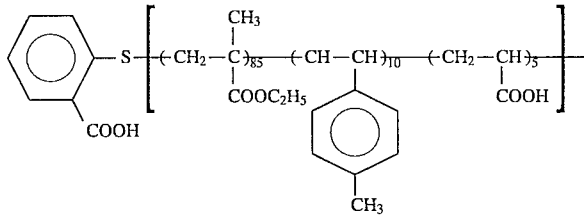 (B-24) Mw $6 \times 10^3$ | 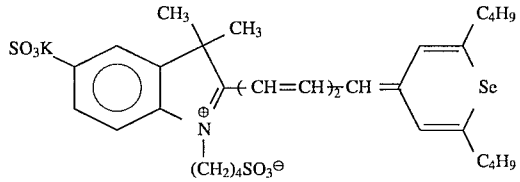 (D-7) | (P-13) |

EXAMPLE 65

Full-color duplicate was prepared in the same manner as in Example 1 except for using 6 g of Thermoplastic Resin Grain (AR-1) having a core/shell structure in place of 4.2 g of Thermoplastic Resin Grain (ARH-3) and 1.8 g of Thermoplastic Resin Grain (ARL-3). The color duplicate obtained exhibited the excellent characteristics same as those in Example 1.

Further, the transfer of toner images to coated paper was conducted in the same manner as above except for changing the transfer pressure to 4 kgf/cm$^2$ and the transportation speed to 100 mm/sec. The color duplicate obtained exhibited the excellent characteristics same as above. These results demonstrate that the reduced pressure and increased speed for transfer can be achieved by employing the thermoplastic resin grains of the core/shell structure according to the present invention.

While the invention has been described in detail and with reference to specific embodiments thereof, it will be apparent to one skilled in the art that various changes and modifications can be made therein without departing from the spirit and scope thereof.

What is claimed is:

1. A method of forming an electrophotographic color transfer image comprising forming at least one color toner image on a transfer layer provided on the surface of an electrophotographic light-sensitive element by an electrophotographic process and heat-transferring the toner image together with the transfer layer onto a receiving material wherein the surface of the electrophotographic light-sensitive element has an adhesive strength of not more than 200 gram.force, which is measured according to JIS Z 0237-1980 "Testing methods of pressure sensitive adhesive tapes and sheets" and wherein the transfer layer mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C.

2. A method of forming an electrophotographic color transfer image comprising forming a transfer layer which mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C. on a surface of an electrophotographic light-sensitive element which surface has an adhesive strength of not more than 200 gram.force, which is measured according to JIS Z 0237-1980 "Testing methods of pressure sensitive adhesive tapes and sheets", forming at least one color toner image on the transfer layer by an electrophotographic process and heat-transferring the toner image together with the transfer layer onto a receiving material, and wherein the electrophotographic light-sensitive element is repeatedly usable.

3. A method of forming an electrophotographic color transfer image as claimed in claim 2, wherein the transfer layer is formed by a hot-melt coating method.

4. A method of forming an electrophotographic color transfer image as claimed in claim 2, wherein the transfer layer is formed by an electrodeposition coating method.

5. A method of forming an electrophotographic color transfer image as claimed in claim 2, wherein the transfer layer is formed by a transfer method.

6. A method of forming an electrophotographic color transfer image as claimed in claim 4, wherein the electrodeposition coating method is carried out using grains comprising the thermoplastic resin supplied as a dispersion thereof in an electrically insulating solvent having an electric resistance of not less than $10^8$ Ω.cm and a dielectric constant of not more than 3.5.

7. A method of forming an electrophotographic color transfer image as claimed in claim 4, wherein the electrodeposition coating method is carried out using grains comprising the thermoplastic resin which are supplied between the electrophotographic light-sensitive element and an electrode placed in face of the light-sensitive element, and migrate due to electrophoresis according to potential gradient applied from an external power source to adhere to or electrodeposit on the electrophotographic light-sensitive element, to thereby form a film.

8. A method of forming an electrophotographic color transfer image as claimed in claim 6, wherein the grains comprising the thermoplastic resin have a core/shell structure.

9. An electrophotographic light-sensitive material comprising an electrophotographic light-sensitive element a surface of which has an adhesive strength of not more than 200 gram.force, which is measured according to JIS Z 0237-1980 "Testing methods of pressure sensitive adhesive tapes and sheets" and a transfer layer provided thereon which mainly contains a thermoplastic resin (AH) having a glass transition point of not more than 140° C. or a softening point of not more than 180° C. and a thermoplastic resin (AL) having a glass transition point of not more than 45° C. or a softening point of not more than 60° C. in which a difference in the glass transition point or softening point between the resin (AH) and the resin (AL) is at least 2° C.

10. An electrophotographic light-sensitive material as claimed in claim 9, wherein the electrophotographic light-sensitive element comprises amorphous silicon as a photoconductive substance.

11. An electrophotographic light-sensitive material as claimed in claim 9, wherein the electrophotographic light-sensitive element contains a polymer having a polymer component containing at least one of a silicon atom and a fluorine atom in the region near to the surface thereof.

12. An electrophotographic light-sensitive material as claimed in claim 11, wherein the polymer is a block copolymer comprising at least one polymer segment (A) containing at least 50% by weight of a fluorine atom and/or silicon atom-containing polymer component and at least one polymer segment (B) containing 0 to 20% by weight of a fluorine atom and/or silicon atom-containing polymer component, the polymer segments (A) and (B) being bonded in the form of blocks.

13. An electrophotographic light-sensitive material as claimed in claim 11, wherein the polymer further contains a polymer component containing a photo and/or heat-curable group.

14. An electrophotographic light-sensitive material as claimed in claim 12, wherein the polymer further contains a polymer component containing a photo and/or heat-curable group.

15. An electrophotographic light-sensitive material as claimed in claim 12, wherein the electrophotographic light-sensitive element further contains a photo- and/or heat-curable resin.

16. An electrophotographic light-sensitive material as claimed in claim 9, wherein the transfer layer is composed of a lower layer which is in contact with the surface of the electrophotographic light-sensitive element and which comprises a thermoplastic resin having a relatively high glass transition point or softening point and an upper layer provided thereon comprising a thermoplastic resin having a relatively low glass transition point or softening point, and in which the difference in the glass transition point or softening point therebetween is at least 2° C.

17. An electrophotographic light-sensitive material as claimed in claim 9, wherein at least one of the thermoplastic resins (AH) and (AL) contains a polymer component (s) containing a moiety having at least one of a fluorine atom and a silicon atom.

18. An electrophotographic light-sensitive material as claimed in claim 17, wherein the polymer components (s) are present as a block in the thermoplastic resin.

* * * * *